US012698542B2

(12) United States Patent
Valdez et al.

(10) Patent No.: US 12,698,542 B2
(45) Date of Patent: Aug. 4, 2026

(54) METHOD AND SYSTEM OF MANUFACTURING COILED TUBING

(71) Applicant: TENARIS COILED TUBES, LLC, Houston, TX (US)

(72) Inventors: Martin Emiliano Valdez, Campana (AR); Diego Javier Monterosso, Houston, TX (US); Jorge M. Mitre, Houston, TX (US)

(73) Assignee: TENARIS COILED TUBES, LLC, Houston, TX (US)

( * ) Notice: Subject to any disclaimer, the term of this patent is extended or adjusted under 35 U.S.C. 154(b) by 0 days.

(21) Appl. No.: 17/479,806

(22) Filed: Sep. 20, 2021

(65) Prior Publication Data

US 2022/0074008 A1 Mar. 10, 2022

Related U.S. Application Data

(63) Continuation of application No. 15/236,056, filed on Aug. 12, 2016, now Pat. No. 11,124,852.

(51) Int. Cl.
*C21D 9/00* (2006.01)
*C21D 1/18* (2006.01)
(Continued)

(52) U.S. Cl.
CPC ..... *C21D 9/08* (2013.01); *C21D 1/18* (2013.01); *C21D 6/004* (2013.01); *C21D 6/005* (2013.01);
(Continued)

(58) Field of Classification Search
CPC ..... C21D 11/00; C21D 11/005; C21D 1/18; C21D 6/004; C21D 6/005; C21D 6/008;
(Continued)

(56) References Cited

U.S. PATENT DOCUMENTS 3,316,395 A 4/1967 Lavin
3,316,396 A 4/1967 Trott et al.
(Continued)

FOREIGN PATENT DOCUMENTS

AR 0050159 10/2006
CA 2319926 7/2008
(Continued)

OTHER PUBLICATIONS

Aggarwal et al., "Qualification of Solutions for Improving Fatigue Life at SCR Touch Down Zone", Deep Offshore Technology Conference, Nov. 8-10, 2005, Vitoria, Espirito Santo, Brazil, 12 pages.

(Continued)

*Primary Examiner* — Matthew E. Hoban
*Assistant Examiner* — Lynne Edmondson
(74) *Attorney, Agent, or Firm* — Morgan, Lewis & Bockius LLP

(57) ABSTRACT

A system includes a feeder configured to feed a continuous length of a tube at a predefined rate, a speed sensor configured to determine a feed rate of the continuous length of the tube, a first geometry sensor configured to determine one or more geometric dimensions of a portion of the continuous length of the tube, a first treatment station comprising a first entrance, a first exit, and a first heat treatment zone therebetween, the first heat treatment zone comprising at least one first zone heating element, and a controller configured to power the first zone heating element at a first heat treatment power level based on a first heat treatment target value, the feed rate, one or more of the geometric dimensions, and a first heating element value of the first zone heating element. The system may also include additional heat treatment and cooling stations.

6 Claims, 5 Drawing Sheets

(51) Int. Cl.

| | |
|---|---|
| ***C21D 6/00*** | (2006.01) |
| ***C21D 9/08*** | (2006.01) |
| ***C21D 11/00*** | (2006.01) |
| ***C22C 38/02*** | (2006.01) |
| ***C22C 38/04*** | (2006.01) |
| ***C22C 38/40*** | (2006.01) |

(52) U.S. Cl.
CPC ..... *C21D 6/008* (2013.01); *C21D 9/0006* (2013.01); *C21D 9/0056* (2013.01); *C21D 11/00* (2013.01); *C22C 38/02* (2013.01); *C22C 38/04* (2013.01); *C22C 38/40* (2013.01)

(58) Field of Classification Search
CPC ..... C21D 9/0006; C21D 9/0056; C21D 9/08; C22C 38/02; C22C 38/04; C22C 38/40
See application file for complete search history.

(56) References Cited

U.S. PATENT DOCUMENTS 3,325,174 A 6/1967 Weaver
3,362,731 A 1/1968 Gasche et al.
3,366,392 A 1/1968 Kennel
3,413,166 A 11/1968 Zackay et al.
3,489,437 A 1/1970 Duret
3,512,789 A 5/1970 Tanner
3,552,781 A 1/1971 Helland
3,572,777 A 3/1971 Blose et al.
3,575,430 A 4/1971 Alpine
3,592,491 A 7/1971 Glover
3,599,931 A 8/1971 Hanson
3,655,465 A 4/1972 Snape et al.
3,733,093 A 5/1973 Seiler
3,810,793 A 5/1974 Heller
3,854,760 A 12/1974 Duret
3,889,989 A 6/1975 Legris et al.
3,891,224 A 6/1975 Ditcher
3,893,919 A 7/1975 Flegel et al.
3,915,697 A 10/1975 Giuliani et al.
3,918,726 A 11/1975 Kramer
3,986,731 A 10/1976 Hoff
4,014,568 A 3/1977 Carter et al.
4,147,368 A 4/1979 Baker et al.
4,163,290 A 7/1979 Sutherlin et al.
4,219,204 A 8/1980 Pippert
4,231,555 A 11/1980 Saito
4,299,412 A 11/1981 Parmann
4,305,059 A 12/1981 Benton
4,310,163 A 1/1982 Pippert
4,336,081 A 6/1982 Hijikata et al.
4,345,739 A 8/1982 Wheatley
4,354,882 A 10/1982 Greer
4,366,971 A 1/1983 Lula
4,368,894 A 1/1983 Parmann
4,373,750 A 2/1983 Mantelle et al.
4,376,528 A 3/1983 Ohshimatani et al.
4,379,482 A 4/1983 Suzuki et al.
4,384,737 A 5/1983 Reusser
4,406,561 A 9/1983 Ewing
4,407,681 A 10/1983 Ina et al.
4,426,095 A 1/1984 Buttner
4,445,265 A 5/1984 Olson et al.
4,473,471 A 9/1984 Robichaud et al.
4,475,839 A 10/1984 Strandberg
4,491,725 A 1/1985 Pritchard
4,506,432 A 3/1985 Smith
4,526,628 A 7/1985 Ohno et al.
4,527,815 A 7/1985 Smith
4,564,392 A 1/1986 Ohhashi et al.
4,570,982 A 2/1986 Blose et al.
4,591,195 A 5/1986 Chelette et al.
4,592,558 A 6/1986 Hopkins
4,601,491 A 7/1986 Bell, Jr. et al.
4,602,807 A 7/1986 Bowers
4,623,173 A 11/1986 Handa et al.
4,629,218 A 12/1986 Dubois
4,662,659 A 5/1987 Blose et al.
4,674,756 A 6/1987 Fallon et al.
4,688,832 A 8/1987 Ortloff et al.
4,706,997 A 11/1987 Carstensen
4,710,245 A 12/1987 Roether
4,721,536 A 1/1988 Koch et al.
4,758,025 A 7/1988 Frick
4,762,344 A 8/1988 Perkins et al.
4,812,182 A 3/1989 Fang et al.
4,814,141 A 3/1989 Imai et al.
4,844,517 A 7/1989 Beiley et al.
4,856,828 A 8/1989 Kessler et al.
4,955,645 A 9/1990 Weems
4,958,862 A 9/1990 Cappelli et al.
4,988,127 A 1/1991 Cartensen
5,007,665 A 4/1991 Bovisio et al.
5,067,874 A 11/1991 Foote
5,137,310 A 8/1992 Noel et al.
5,143,381 A 9/1992 Temple
5,154,534 A 10/1992 Guerin et al.
5,180,008 A 1/1993 Aldridge et al.
5,191,911 A 3/1993 Dubois
5,242,199 A 9/1993 Hann et al.
5,328,158 A 7/1994 Lewis et al.
5,348,350 A 9/1994 Blose et al.
5,352,406 A 10/1994 Barteri et al.
5,360,239 A 11/1994 Klementich
5,449,420 A 9/1995 Okada et al.
5,454,883 A 10/1995 Yoshie et al.
5,456,405 A 10/1995 Stagg
5,505,502 A 4/1996 Smith et al.
5,515,707 A 5/1996 Smith
5,538,566 A 7/1996 Gallagher
5,592,988 A 1/1997 Meroni et al.
5,598,735 A 2/1997 Saito et al.
5,653,452 A 8/1997 Jarvenkyla
5,712,706 A 1/1998 Castore et al.
5,794,985 A 8/1998 Mallis
5,810,401 A 9/1998 Mosing et al.
5,860,680 A 1/1999 Drijver et al.
5,879,030 A 3/1999 Clayson et al.
5,879,474 A 3/1999 Bhadeshia et al.
5,944,921 A 8/1999 Cumino et al.
5,993,570 A 11/1999 Gray
6,006,789 A 12/1999 Toyooka et al.
6,030,470 A 2/2000 Hensger et al.
6,044,539 A 4/2000 Guzowksi
6,045,165 A 4/2000 Sugino et al.
6,056,324 A 5/2000 Reimert et al.
6,070,912 A 6/2000 Latham
6,173,968 B1 1/2001 Nelson et al.
6,180,933 B1 * 1/2001 Demidovitch ..... C23C 2/40 219/662
6,188,037 B1 2/2001 Hamada et al.
6,196,530 B1 3/2001 Muhr et al.
6,217,676 B1 4/2001 Takabe et al.
6,248,187 B1 6/2001 Asahi et al.
6,257,056 B1 7/2001 Shibayama
6,267,828 B1 7/2001 Kushida et al.
6,311,965 B1 11/2001 Muhr et al.
6,331,216 B1 12/2001 Toyooka et al.
6,347,814 B1 2/2002 Cerruti
6,349,979 B1 2/2002 Noel et al.
6,358,336 B1 3/2002 Miyata
6,384,388 B1 5/2002 Anderson et al.
6,412,831 B1 7/2002 Noel et al.
6,447,025 B1 9/2002 Smith
6,478,344 B2 11/2002 Pallini, Jr. et al.
6,481,760 B1 11/2002 Noel et al.
6,494,499 B1 12/2002 Galle, Sr. et al.
6,514,359 B2 2/2003 Kawano
6,527,056 B2 3/2003 Newman
6,540,848 B2 4/2003 Miyata et al.
6,550,822 B2 4/2003 Mannella et al.
6,557,906 B1 5/2003 Carcagno
6,558,484 B1 5/2003 Onoe et al.
6,581,940 B2 6/2003 Dittel

(56) References Cited

U.S. PATENT DOCUMENTS 6,632,296 B2 10/2003 Yoshinaga et al.
6,648,991 B2 11/2003 Turconi et al.
6,669,285 B1 12/2003 Park et al.
6,669,789 B1 12/2003 Edelman et al.
6,682,610 B1 1/2004 Inoue
6,683,834 B2 1/2004 Ohara et al.
6,709,534 B2 3/2004 Kusinski et al.
6,752,436 B1 6/2004 Verdillon
6,755,447 B2 6/2004 Galle, Jr. et al.
6,764,108 B2 7/2004 Ernst et al.
6,767,417 B2 7/2004 Fujita et al.
6,814,358 B2 11/2004 Keck
6,851,727 B2 2/2005 Carcagno et al.
6,857,668 B2 2/2005 Otten et al.
6,883,804 B2 4/2005 Cobb
6,905,150 B2 6/2005 Carcagno et al.
6,921,110 B2 7/2005 Marotti et al.
6,958,099 B2 10/2005 Nakamura et al.
6,971,681 B2 12/2005 Dell'Erba et al.
6,991,267 B2 1/2006 Ernst et al.
7,014,223 B2 3/2006 Della Pina et al.
7,066,499 B2 6/2006 Della Pina et al.
7,074,283 B2 7/2006 Omura
7,083,686 B2 8/2006 Itou
7,108,063 B2 9/2006 Carstensen
7,118,637 B2 10/2006 Kusinski et al.
7,182,140 B2 2/2007 Wood
7,214,278 B2 5/2007 Kusinski et al.
7,255,374 B2 8/2007 Carcagno et al.
7,264,684 B2 9/2007 Numata et al.
7,284,770 B2 10/2007 Dell'erba et al.
7,310,867 B2 12/2007 Corbett, Jr.
7,431,347 B2 10/2008 Ernst et al.
7,464,449 B2 12/2008 Santi et al.
7,475,476 B2 1/2009 Roussie
7,478,842 B2 1/2009 Reynolds, Jr. et al.
7,506,900 B2 3/2009 Carcagno et al.
7,621,034 B2 11/2009 Roussie
7,635,406 B2 12/2009 Numata et al.
7,735,879 B2 6/2010 Toscano et al.
7,744,708 B2 6/2010 Lopez et al.
7,753,416 B2 7/2010 Mazzaferro et al.
7,862,667 B2 1/2011 Turconi et al.
8,002,910 B2 8/2011 Tivelli et al.
8,007,601 B2 8/2011 Lopez et al.
8,007,603 B2 8/2011 Garcia et al.
8,016,362 B2 9/2011 Ltoga
8,175,744 B2 5/2012 Biester et al.
8,262,094 B2 9/2012 Beele
8,262,140 B2 9/2012 Santi et al.
8,317,946 B2 11/2012 Arai et al.
8,328,958 B2 12/2012 Turconi et al.
8,328,960 B2 12/2012 Gomez et al.
8,333,409 B2 12/2012 Santi et al.
8,414,715 B2 4/2013 Altschuler et al.
8,544,304 B2 10/2013 Santi
8,636,856 B2 1/2014 Altschuler et al.
8,821,653 B2 9/2014 Anelli et al.
8,840,152 B2 9/2014 Carcagno et al.
8,926,771 B2 1/2015 Agazzi
9,004,544 B2 4/2015 Carcagno et al.
9,163,296 B2 10/2015 Valdez et al.
9,187,811 B2 11/2015 Gomez et al.
9,222,156 B2 12/2015 Altschuler et al.
9,234,612 B2 1/2016 Santi et al.
9,340,847 B2 5/2016 Altschuler et al.
9,383,045 B2 7/2016 Santi et al.
9,598,746 B2 3/2017 Anelli et al.
9,745,640 B2 8/2017 Valdez et al.
9,803,256 B2 10/2017 Valdez et al.
2001/0035235 A1 11/2001 Kawano
2002/0011284 A1 1/2002 Von Hagen et al.
2002/0153671 A1 10/2002 Raymond et al.
2002/0158469 A1 10/2002 Mannella et al.
2003/0019549 A1 1/2003 Turconi et al.
2003/0111146 A1 6/2003 Kusinski et al.
2003/0116238 A1 6/2003 Fujita
2003/0155052 A1 8/2003 Kondo et al.
2003/0165098 A1 9/2003 Ohara et al.
2003/0168859 A1 9/2003 Watts
2004/0118490 A1 6/2004 Klueh et al.
2004/0118569 A1 6/2004 Brill et al.
2004/0131876 A1 7/2004 Ohgami et al.
2004/0139780 A1 7/2004 Cai et al.
2004/0187971 A1 9/2004 Omura
2004/0195835 A1 10/2004 Noel et al.
2004/0262919 A1 12/2004 Dutilleul et al.
2005/0012278 A1 1/2005 Delange
2005/0076975 A1 4/2005 Lopez et al.
2005/0087269 A1 4/2005 Merwin
2005/0093250 A1 5/2005 Santi et al.
2005/0166986 A1 8/2005 Dell'erba et al.
2006/0006600 A1 1/2006 Roussie
2006/0124211 A1 6/2006 Takano et al.
2006/0137781 A1 6/2006 Kusinski et al.
2006/0157539 A1 7/2006 Dubois
2006/0169368 A1 8/2006 Lopez et al.
2006/0231168 A1 10/2006 Nakamura et al.
2006/0231186 A1 10/2006 Nakmura et al.
2006/0243355 A1 11/2006 Haiderer et al.
2006/0273586 A1 12/2006 Reynolds et al.
2007/0039149 A1 2/2007 Roussie
2007/0089813 A1 4/2007 Tivelli
2007/0137736 A1 6/2007 Omura et al.
2007/0216126 A1 9/2007 Lopez et al.
2007/0246219 A1 10/2007 Manella et al.
2008/0047635 A1 2/2008 Kanda et al.
2008/0115863 A1 5/2008 McCrink et al.
2008/0129044 A1 6/2008 Carcagno et al.
2008/0219878 A1 9/2008 Kanda et al.
2008/0226396 A1 9/2008 Garcia et al.
2008/0226491 A1 9/2008 Satou et al.
2008/0257459 A1 10/2008 Arai et al.
2008/0264129 A1 10/2008 Cheppe et al.
2008/0286504 A1 11/2008 Asahi et al.
2008/0303274 A1 12/2008 Mazzaferro et al.
2008/0314481 A1 12/2008 Garcia et al.
2009/0010794 A1 1/2009 Turconi et al.
2009/0033087 A1 2/2009 Carcagno et al.
2009/0047166 A1 2/2009 Tomomatsu et al.
2009/0071954 A1 3/2009 Fujita et al.
2009/0101242 A1 4/2009 Lopez et al.
2009/0114318 A1 5/2009 Arai et al.
2009/0148334 A1 6/2009 Stephenson
2009/0226988 A1 9/2009 Tajima et al.
2010/0136363 A1 6/2010 Valdez et al.
2010/0187808 A1 7/2010 Santi
2010/0193085 A1 8/2010 Garcia
2010/0206553 A1 8/2010 Bailey et al.
2010/0292823 A1* 11/2010 Biester ..... C21D 11/00 700/103
2010/0294401 A1 11/2010 Gomez
2010/0319814 A1 12/2010 Perez
2010/0327550 A1 12/2010 Lopez
2011/0042946 A1 2/2011 Santi
2011/0077089 A1 3/2011 Hirai et al.
2011/0097235 A1 4/2011 Turconi et al.
2011/0133449 A1 6/2011 Mazzaferro
2011/0233925 A1 9/2011 Pina
2011/0247733 A1 10/2011 Arai et al.
2011/0259482 A1 10/2011 Peters et al.
2011/0284137 A1 11/2011 Kami et al.
2012/0018056 A1 1/2012 Nakagawa et al.
2012/0186686 A1* 7/2012 Valdez ..... C22C 38/06 138/177
2012/0199255 A1 8/2012 Anelli
2012/0267014 A1 10/2012 Hitoshio et al.
2013/0000790 A1 1/2013 Arai et al.
2013/0004787 A1 1/2013 Ishiyama et al.
2013/0199674 A1 8/2013 Altschuler et al.
2013/0264123 A1 10/2013 Altschuler et al.
2014/0021244 A1 1/2014 DuBois
2014/0027497 A1 1/2014 Rowland et al.
2014/0057121 A1 2/2014 Altschuler et al.

(56) References Cited

U.S. PATENT DOCUMENTS

| | | | |
|---|---|---|---|
| 2014/0137992 | A1 | 5/2014 | Ishiguro et al. |
| 2014/0251512 | A1 | 9/2014 | Gomez |
| 2014/0272448 | A1 | 9/2014 | Valdez et al. |
| 2014/0299235 | A1 | 10/2014 | Anelli |
| 2014/0299236 | A1 | 10/2014 | Anelli |
| 2015/0345865 | A1 | 12/2015 | Rivera |
| 2015/0368986 | A1 | 12/2015 | Narikawa |
| 2016/0024625 | A1 | 1/2016 | Valdez |
| 2016/0102856 | A1 | 4/2016 | Minami |
| 2016/0281188 | A1 | 9/2016 | Valdez et al. |
| 2016/0305192 | A1 | 10/2016 | Buhler |
| 2017/0335421 | A1 | 11/2017 | Valdez et al. |
| 2018/0044747 | A1 | 2/2018 | Valdez et al. |
| 2018/0051353 | A1 | 2/2018 | Valdez et al. |
| 2018/0223384 | A1 | 8/2018 | Valdez et al. |

FOREIGN PATENT DOCUMENTS

| | | |
|---|---|---|
| CA | 2685001 | 11/2008 |
| CN | 1401809 | 3/2003 |
| CN | 1487112 | 4/2004 |
| CN | 1292429 | 12/2006 |
| CN | 101480671 | 7/2009 |
| CN | 101542002 | 9/2009 |
| CN | 101613829 | 12/2009 |
| CN | 101413089 | 11/2010 |
| DE | 3310226 | 10/1984 |
| DE | 4446806 | 5/1996 |
| EA | 010037 | 6/2008 |
| EA | 012256 | 8/2009 |
| EP | 0032265 | 7/1981 |
| EP | 0092815 | 11/1983 |
| EP | 0104720 | 4/1984 |
| EP | 0159385 | 10/1985 |
| EP | 0309179 | 3/1989 |
| EP | 0340385 | 11/1989 |
| EP | 0329990 | 11/1992 |
| EP | 0658632 | 6/1995 |
| EP | 0753595 | 1/1997 |
| EP | 0788850 | 8/1997 |
| EP | 0828007 | 3/1998 |
| EP | 0989196 | 3/2000 |
| EP | 1008660 | 6/2000 |
| EP | 1027944 | 8/2000 |
| EP | 1065423 | 1/2001 |
| EP | 1269059 | 1/2003 |
| EP | 1277848 | 1/2003 |
| EP | 1288316 | 3/2003 |
| EP | 1296088 | 3/2003 |
| EP | 1362977 | 11/2003 |
| EP | 1413639 | 4/2004 |
| EP | 1182268 | 9/2004 |
| EP | 1705415 | 9/2006 |
| EP | 1726861 | 11/2006 |
| EP | 1876254 | 1/2008 |
| EP | 1914324 | 4/2008 |
| EP | 2000629 | 12/2008 |
| EP | 1554518 | 1/2009 |
| EP | 2028284 | 2/2009 |
| EP | 2133442 | 12/2009 |
| EP | 2216576 | 8/2010 |
| EP | 2239343 | 10/2010 |
| EP | 2778239 | 9/2014 |
| FR | 1149513 | 12/1957 |
| FR | 1489013 | 7/1967 |
| FR | 2704042 | 10/1994 |
| FR | 2848282 | 6/2004 |
| FR | 2855587 | 12/2004 |
| FR | 1717324 | 11/2006 |
| GB | 1398214 | 6/1973 |
| GB | 1428433 | 3/1976 |
| GB | 2104919 | 3/1983 |
| GB | 2234308 | 1/1991 |
| GB | 2276647 | 10/1994 |
| GB | 2388169 | 11/2003 |
| JP | S52-2825 | 1/1977 |
| JP | S58-187684 | 12/1983 |
| JP | S60-116796 | 6/1985 |
| JP | S60-215719 | 10/1985 |
| JP | S60-261888 | 12/1985 |
| JP | S61-103061 | 5/1986 |
| JP | S61-270355 | 11/1986 |
| JP | S63-230847 | 9/1988 |
| JP | S63-230851 | 9/1988 |
| JP | H01-242761 | 9/1989 |
| JP | H01-259124 | 10/1989 |
| JP | H01-259125 | 10/1989 |
| JP | H01-283322 | 11/1989 |
| JP | H04-021718 | 1/1992 |
| JP | H04-107214 | 4/1992 |
| JP | H04-231414 | 8/1992 |
| JP | H05-74928 | 10/1993 |
| JP | H05-287381 | 11/1993 |
| JP | H06-042645 | 2/1994 |
| JP | H06-093339 | 4/1994 |
| JP | H06-172859 | 6/1994 |
| JP | H06-220536 | 8/1994 |
| JP | H07-139666 | 5/1995 |
| JP | H07-197125 | 8/1995 |
| JP | H08-311551 | 11/1996 |
| JP | H09-217120 | 8/1997 |
| JP | H09-235617 | 9/1997 |
| JP | H10-140250 | 5/1998 |
| JP | H10-176239 | 6/1998 |
| JP | H10-280037 | 10/1998 |
| JP | H11-140580 | 5/1999 |
| JP | H11-229079 | 8/1999 |
| JP | 2000-063940 | 2/2000 |
| JP | 2000-178645 | 6/2000 |
| JP | 2000-248337 | 9/2000 |
| JP | 2000-313919 | 11/2000 |
| JP | 2001-131698 | 5/2001 |
| JP | 2001-164338 | 6/2001 |
| JP | 2001-172739 | 6/2001 |
| JP | 2001-220653 | 8/2001 |
| JP | 2001-271134 | 10/2001 |
| JP | 2002-096105 | 4/2002 |
| JP | 2002-130554 | 5/2002 |
| JP | 2004-011009 | 1/2004 |
| JP | S60-174822 | 9/2005 |
| JP | 2007-031769 | 2/2007 |
| JP | 2008526524 | 7/2008 |
| WO | WO 1984002947 | 8/1984 |
| WO | WO 1994029627 | 12/1994 |
| WO | WO 1996022396 | 7/1996 |
| WO | WO 2000006931 | 2/2000 |
| WO | WO 2000070107 | 11/2000 |
| WO | WO 2001075345 | 10/2001 |
| WO | WO 2001088210 | 11/2001 |
| WO | WO 2002029290 | 4/2002 |
| WO | WO 2002035128 | 5/2002 |
| WO | WO 2002068854 | 9/2002 |
| WO | WO 2002086369 | 10/2002 |
| WO | WO 2002093045 | 11/2002 |
| WO | WO 2003033856 | 4/2003 |
| WO | WO 2003048623 | 6/2003 |
| WO | WO 2003087646 | 10/2003 |
| WO | WO 2004023020 | 3/2004 |
| WO | WO 2004031420 | 4/2004 |
| WO | WO 2004033951 | 4/2004 |
| WO | WO 2004053376 | 6/2004 |
| WO | WO 2004097059 | 11/2004 |
| WO | WO 2004109173 | 12/2004 |
| WO | WO 2006003775 | 6/2005 |
| WO | WO 2005080621 | 9/2005 |
| WO | WO 2006009142 | 1/2006 |
| WO | WO 2006087361 | 4/2006 |
| WO | WO 2006078768 | 7/2006 |
| WO | WO 2006086143 | 8/2006 |
| WO | WO 2007002576 | 1/2007 |
| WO | WO 2007017082 | 2/2007 |
| WO | WO 2007017161 | 2/2007 |
| WO | WO 2007023806 | 3/2007 |
| WO | WO 2007028443 | 3/2007 |

(56) References Cited

FOREIGN PATENT DOCUMENTS

| | | |
|---|---|---|
| WO | WO 2007034063 | 3/2007 |
| WO | WO 2007063079 | 6/2007 |
| WO | WO 2008003000 | 1/2008 |
| WO | WO 2008007737 | 1/2008 |
| WO | WO 2008090411 | 7/2008 |
| WO | WO 2008110494 | 9/2008 |
| WO | WO 2008127084 | 10/2008 |
| WO | WO 2009000851 | 12/2008 |
| WO | WO 2009000766 | 1/2009 |
| WO | WO 2009010507 | 1/2009 |
| WO | WO 2009027308 | 3/2009 |
| WO | WO 2009027309 | 3/2009 |
| WO | WO 2009044297 | 4/2009 |
| WO | WO 2009065432 | 5/2009 |
| WO | WO 2009106623 | 9/2009 |
| WO | WO 2010061882 | 6/2010 |
| WO | WO 2010122431 | 10/2010 |
| WO | WO 2011152240 | 12/2011 |
| WO | WO 2013007729 | 1/2013 |

OTHER PUBLICATIONS

Anelli et al., "Metallurgical design of advanced heavy wall seamless pipes for deep-water applications", 4th International Conference on Pipeline Technology, May 9 to 13, 2004, Ostend, Bel, 11 pages.

Asahi et al., "Development of Ultra-high-strength Linepipe, X120," Nippon Steel Technical Report, Jul. 2004, 90:82-87.

ASM Handbook, Mechanical Tubing and Cold Finishing, Metals Handbook Desk Edition, (2000), 5 pages.

Beretta et al., "Fatigue Assessment of Tubular Automotive Components in Presence of Inhomogeneities", Proceedings of IMECE2004, ASME International Mechanical Engineering Congress, Nov. 13-19, 2004, 8 pages.

Berner, "Tetragonal Iron Sulfide", Science, Aug. 31, 1962, 137(3531):669, 3 pages.

Bernstein et al., "The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.

Bhadeshia et al., "Steels, Microstructure and Properties," Third Edition, Elsevier, Published in 2006, p. 296, 3 pages.

Bouegue, "Equilibria in a sulfide rich water from Enghien-les-Bains, France", Geochimica et Cosmochimica Acta, Pergamon Press, Great Britain, 1977, 41:1751-1758.

British Standard , "Seamless Steel Tubes for Pressure Purposes-Technical Delivery Conditions-Part 1: Non-alloy Steel Tubes with Specified Room Temperature Properties" British Standard BS EN 10216- 1:2002 E: 1-26, published May 2002.

British Standard, "Seamless Steel Tubes for Pressure Purposes-Technical Delivery Conditions-Part 2: Non-alloy and Alloy Steel Tubes with Specified Elevated Temperature Properties" British Standard BS EN 10216E: 1-45, published Aug. 2007.

British Standard, "Seamless Steel Tubes for Pressure Purposes-Technical Delivery Conditions-Part 3: Alloy Fine Grain Steel Tubes" British Standard BS EN 10216-3:2002:2004 E: 1-34, published Mar. 2004.

British Standard, "Seamless Steel Tubes for Pressure Purposes-Technical Delivery Conditions-Part 4: Non-alloy and Alloy Steel Tubes with Specified Low Temperature Properties" British Standard BS EN 10216-4:2002:2004 E:1-30, published Mar. 2004.

Bruzzoni et al., "Study of Hydrogen Permeation Through Passive Films on Iron Using Electrochemical Impedance Spectroscopy", PhD Thesis, 2003, Universidad Nacional del Comahue de Buenos Aires, Argentina (Abstract), 5 pages.

Cancio et al., "Characterization of microalloy precipitates in the austenitic range of high strength low alloy steels", Steel Research, 2002, 73(8):340-346.

Carboni et al., "Casting and rolling of API X 70 grades for artic application in a thin slab rolling plant", Stahl u Eisen, 2008, 1:131-134.

Chitwood et al.: "High-Strength Coiled Tubing Expands Service Capabilities", as presented at the 24th Annual OTC in Houston, Texas, May 4-7, 1992, in 15 pages.

Coloschi et al., "A Metallurgical Look at Coiled Tubing." Paper SPE-163930-MS, presented at SPE/ICoTA Coiled Tubing Well Intervention Conference and Exhibition, The Woodlands, Texas, Mar. 26-27, 26, 2013, 9 pages.

Coloschi et al., "Performance of Coiled Tubing in Sour Environments, Improving Serviceability through Metallurgical Design." NACE International Corrosion Conference and Expo, May 12, 2015, 15 pages.

Coloschi, et al., "The Effect of Processing Variables on High Strength Coiled Tubing Performance," in Materials Science and Technology-Association for Iron & Steel Technology, 3:1805-1814, Oct. 27-31, 2013, 10 pages.

Craig, "Effect of Copper on the Protectiveness of Iron Sulfide Films", Corrosion, National Association of Corrosion Engineers, Sep. 1984, 40(9):471-474.

D.O.T. 178.65 Spec. 39, pp. 831-840, Non reusable (non refillable) cylinders, Oct. 1, 2002, 10 pages.

Davis et al., "ASM—Specialty Handbook—Carbon and alloy steels" ASM Specialty Handbook, Carbon and Alloy Steels, 1996, pp. 12-27, 90-101, 591-598, XP002364757 US.

Davis et al., "Mechanical Tubing and Cold Finishing," Metals Handbook Desk Edition, (2000), 5 pages.

DeMedics, "Cubic FeS, A Metastable Iron Sulfide", Science, American Association for the Advancement of Science, Steen bock Memorial Library, Dec. 11, 1970, 170(3963):723-728.

Echaniz et al., "Advances in Corrosion Control and Materials in Oil and Gas Production" Papers from Eurocorr 97 and Eurocorr 98, 13, P. S. Jackman and L. M. Smith, Published for the European Federation of Corrosion, No. 26, 9 pages.

Echaniz, "The Effect of Microstructure on the KISSC of Low Alloy Carbon Steels", NACE Corrosion '98, EE. UU., Mar. 1998, 9 pages.

Elliot et al., "Development and Compatibility Testing of Coiled Tubing with 140-ksi Specified Minimum Yield Strength," SPE-184806-MS, SPE/ICoTA Coiled Tubing and Well Intervention Conference and Exhibition, Society of Petroleum Engineer, Mar. 21, 2017, 11 pages.

European Extended Search Report in European Application No. 12152516.6, dated Jun. 25, 2012, 6 pages.

Fang et al., "The Developing Prospect of Air-cooled Bainitic Steels", International Journal of Issi, Feb. 1, 2005, 2(2):9-18.

Faszold et al., "Full-Scale Fatigue Testing With 130K Yield Tubing." Paper SPE-153945, Presented at SPE/ICoTA Coiled Tubing & Well Intervention Conference and Exhibition Jan. 2012, Society of Petroleum Engineers, 6 pages.

Fratini et al., "Improving friction stir welding of blanks of different thicknesses," Materials Science and Engineering A, Jun. 25, 2007, 459:209-215.

Fritz et al., "Characterization of electroplated nickel", Microsystem Technologies, Dec. 31, 2002, 9(1-2):87-91.

Gojic et al., "The Susceptibility to the Hydrogen Embrittlement of Low Alloy Cr and CrMo Steels", ISIJ International, 1997, 37(4):412-418.

Gomez, et al.: "Air cooled bainitic steels for strong, seamless pipes—Part 1—allowy design, kinetics and microstructure", Materials Science and Technology, Dec. 1, 2009, (XP002611498) 25(12): 1501-1507.

Heckmann et al., "Development of low carbon Nb—Ti—B microalloyed steels for high strength large diameter linepipe, lronmaking and Steelmaking," 2005, 32(4):337-341.

Hollomon et al., "Time-tempered Relations in Tempering Steel." New York Meeting, Feb. 1945, pp. 223-249.

Howells et al., "Challenges for Ultra-Deep Water Riser Systems", I IR, London, Apr. 1997, 11 pages.

Hutchings et al., "Ratio of Specimen thickness to charging area for reliable hydrogen permeation measurement," British Corrosion. Journal, 1993, 28(4):309-312.

Iino et al., "Aciers pour pipe-lines resistant au cloquage et au criquage dus a l'hydrogene", Revue de Metallurgie, 1979, 76(8-9):591-609.

(56) References Cited

OTHER PUBLICATIONS

Ikeda et al., "Influence of Environmental Conditions and Metallurgical Factors on Hydrogen Induced Cracking of Line Pipe Steel", Corrosion/SO, National Association of Corrosion Engineers, Houston, Texas. Mar. 3-7, 1980, 8:8/1-8/18.
International Standard Publication. Petroleum and natural gas industries—Materials for use in H2Scontaining environments in oil and gas production. ANSI/NACE ISO, 145 pages, 2009.
Izquierdo, et al.: "Qualification of Weldable X65 Grade Riser Sections with Upset Ends to Improve Fatigue Performance of Deepwater Steel Catenary Risers," Proceedings of the Eighteenth International Offshore and Polar Engineering Conference, Vancouver, BC, Jul. 6-11, 2008, 1 page.
Jacobs et al., "Trace Metal Solubility in an Anoxid Fjord," Earth and Planetary Sci. Letters, Elsevier Scientific Publishing Company, Sep. 1982, 60:237-252.
Johnston et al., "Effect of Al203 and Ti02 Additions on the Lubrication Characteristics of Mould Fluxes", Molten Slags, Fluxes and Salts Conference, Jan. 1997 pp. 845-850.
Keizer, "Statistical Thermodynamics of Nonequilibrium Processes", Springer-Verlag, 1987, 9 pages.
Kishi et al., "Mold Powder Technology for Continuous Casting of Ti-Stabilized Stainless Steels", Nippon Steel Technical Report, No. 34, Jul. 1987, pp. 11-19.
Korolev, "The Role of Iron Sulfides in the Accumulation of Molybdenum in Sedimentary Rocks of the Reduced Zone", Geochemistry, 1958, vol. 4, pp. 452-463.
Lee er al, "The Effect of the Interface Character of TiC Particles on Hydrogen Trapping in Steel", Acta Metal I., 1987, vol. 35, Issue 11, pp. 2695-2700.
Mehling, "Hot Upset Forging," ASM Handbook vol. 14, 1998, pp. 84-95.
Mishael et al., "Practical Applications of Hydrogen Permeation Monitoring," Corrosion, Mar. 28-Apr. 1, 2004, Corrosion 2004, Nacional Association of Corrosion Engineers, vol. Reprint No. 04476, 12 pages.
Morice et al., "Moessbauer Studies of Iron Sulfides", J. Inorg. Nucl. Chem., 1969, vol. 31, pp. 3797-3802.
Mukongo et al., "Viscosity Effect of Titanium Pickup by Mould Fluxes for Stainless Steel", Ironmaking and Steelmaking, 2004, vol. 31, No. 2, pp. 135-143.
Mullet et al., "Surface Chemistry and Structural Properties of Mackinawite Prepared by Reaction of Sulfide Ions with Metallic Iron", Geochimica et Cosmochimica Acta, 2002, vol. 66, Issue 5, pp. 829-836.
Murcowchick et al., "Formation of a cubic FeS", American Mineralogist, 1986, vol. 71, pp. 1243-1246.
NACE MR0175/ISO 15156-1 Petroleum and natural gas industries-Materials for use in H2S-containing Environments in oil and gas production-Part 1 : General principles for selection of crackina-resistant materials, Jun. 28, 2007, 175 pages.
Nagata et al., "Titanium nitride precipitation behavior in thin slab cast high strength low alloyed steels", Metallurgical and Materials Transactions A, 2002 , vol. 33A, p. 3099-3110.
Nakai et al., "Development of Steels Resistant to Hydrogen Induced Cracking in Wet Hydrogen Sulfide Environment", Transactions of the ISIJ, 1979, vol. 19, pp. 401-410.
Nandan et al.: "Recent advances in friction-stir welding—Process, weldment structure and properties," Progress in Materials Science 53(2008):980-1023.
Ohashi et al., "Evaluation of r-value of steels using Vickers hardness test", Journal of Physics: Conference Series, Aug. 7, 2012, p. 12045, vol. 379, No. 1, Institute of Physics Publishing, Bristol, GB.
Pollack. Materials Science and Metallurgy, Fourth Edition, pp. 96 and 97, 1988.
Pressure Equipment Directive 97/23/EC, May 29, 1997, downloaded from website: http://ec.europa.eu/enterprise/pressure equipment/ped/index en.html on Aug. 4, 2010.
Prevey et al., "Introduction of Residual Stresses to Enhance Fatigue Performance in the Initial Design", Proceedings of Turbo Expo 2004, Jun. 14-17, 2004, pp. 1-9.
Rickard "The Chemistry of Iron Sulphide Formation at Low Temperatures", Stockholm Contrib. Geo I., 1969, vol. 26, pp. 67-95.
Rolovic et al., "Field Performance of New Coiled Tubing Technology and a New Grade for Improved Sour Service," Paper SPE-184796-MS, SPE/ICoTA Coiled Tubing and Well Intervention Conference and Exhibition, Society of Petroleum Engineers, Mar. 21, 2017, 13 pages.
Shanabarger et al., "H20 Adsorption onto clean oxygen covered iron films", Surface Science, 1996, vol. 365, pp. 614-624.
Shoesmith et al., "Formation of Ferrous Monosulfide Polymorphs During Corrosion of Iron by Aqueous Hydrogen Sulfide at 21 degrees C", Journal of the Electrochemical Society, 1980, 127(5):1007-1015.
Skoczylas et al., "Characterization of the chemical interactions during casting of High-titanium low carbon enameling steels", 1991 Steelmaking Conference Proceeding, pp. 707-717.
Smyth, D., et al.: Steel Tubular Products, Properties and Selection: Irons, Steels, and High-Performance Alloys, vol. 1, ASM Handbook, ASM International, 1990, p. 327-336.
Specification for Threading, Gauging and Thread Inspection of Casing, Tubing, and Line Pipe Threads, American Petroleum Institute, Specification 58, Apr. 2008, 15th Edition, 140 pages.
Taira et al., "HIC and SSC Resistance of Line Pipes for Sour Gas Service", Nippon Kokan Technical Report, 1981, 31(1-13) 14 pages.
Taira et al., "Study on the Evaluation of Environmental Condition of Wet Sour Gas", Corrosion 83 (Reprint. No. 156, National Association of Corrosion Engineers), 1983, p. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris brochure. Coiled Tubes HS80CRA, 2 p. 2008.
Thethi, et al.: "Alternative Construction for High Pressure High Temperature Steel Catenary Risers", Opt USA, Sep. 2003, p. 1-13.
Thewlis., Weldability of X100 linepipe, Science and Technology of Welding and Joining, 2000, vol. 5, Issue 6, pp. 365-377.
Tivelli et al., "Metakkurgical Aspects of Heavy Wall—High Strength Seamless Pipes for Deep Water Applications", RioPipeline, Oct. 17-19, 2005, Rio, Brasil.
Tivelli et al., "Metallurgical Aspects of Heavy Wall—High Strength Seamless Pipes for Deep Water Applications", RioPipeline 2005, Oct. 17 to 19, 2005, Rio (Brasil), Paper nº IBP 1008 05.
Todoroki et al., "Effect of crystallization behavior of mold flux on slab surface quality of a Ti-bearing Fe—Cr—Ni super alloy cast by means of continuous casting process", Materials Science and Engineering A, 2005, 413-414:121-128.
Turconi "Improvement of resistance to SSC initiation and propagation of high strength OCTG through microstructure and precipitation control"; "Paper 01077", NACE International, Houston, TX, Mar. 16, 2001. (XP009141583), 15 pages.
Valdez et al., "The Development of High-Strength Coiled Tubing with Improved Fatigue Performance and H2S Resistance." Paper SPE-173639-MS presented at SPE/JCoTA Coiled Tubing Well Intervention Conforence and Exhibition, The Woodlands, Texas, USA, Mar. 24, 21 pages, (2015).
Vaughan et al., "Moessbauer Studies of Some Sulphide Minerals", J. Inorg Nucl. Chem., 1971, 33:741-746.
Yu, et al.: "Preparation and Properties of Polyimide-Clay Nanocomposite Materials for Anticorrosion Application", Journal of Applied Polymer Science, Mar. 2004, 92:3572-3582.

* cited by examiner

METHOD AND SYSTEM OF MANUFACTURING COILED TUBING

CROSS-REFERENCE TO RELATED PATENT APPLICATIONS

This application is a continuation of and claims the benefit of priority to U.S. patent application Ser. No. 15/236,056, filed Aug. 12, 2016, the contents of which are incorporated by reference herein.

TECHNICAL FIELD

This invention relates to a method and system for manufacturing coiled tubing and more particularly to a method and system for manufacturing coiled tubing using a feed forward control loop for heating a continuously moving tube.

BACKGROUND

Coiled tubing is a continuous length of steel tubing which is coiled on a spool and used in a variety of applications in the oil and gas industry including but not limited to wellbore drilling and re-working existing wellbores. The tubing may be made of a variety of steels or other metal alloys. Coiled tubes may have a variety of diameters, wall thicknesses, and tube lengths. The tubes related to this disclosure may have a total length of up to 50,000 ft. long, with typical lengths ranging from 15,000 to 25,000 ft. Similarly, they may have outer diameters measuring between 1 and 5 inches and wall thicknesses between 0.008 and 0.3 inches.

Coiled tubing (CT) may be used in the oil and gas industry to perform various operations and services including drilling wells, forming wellbores, forming well completion plugs or other components, performing well interventions, performing work-overs, performing production enhancements, etc. These tubes may also be used as line pipes for fluid transport and in water well drilling and maintenance. Other industries may also use coiled tubing for their operations and services.

Coiled tubing is produced by joining several lengths of flat steel using transverse welds oriented at an angle with respect to the hot rolling direction (called bias welds). The resulting long strip is then processed in a forming and welding mill where the steel is shaped into a tube and the seam is welded. The seam welding process may be ERW (Electric Resistance Welding), laser, etc. In some implementations, the resulting continuous tube is then coiled onto a spool as it exits the welding line.

A tapered string of coiled tubing may be produced by varying the thickness of the flat sheets of steel when they are joined into the continuous strip. This produces discrete changes in wall thickness along the coiled tubing string. Alternatively, coiled tubing may be produced using a hot rolling process in which the steel is extruded and formed from a tube with an OD greater than the resulting tubing. This method also allows the OD and/or wall thickness to vary continuously along the length of the coiled tubing string. Alternatively, the strips may have variations in wall thickness coming out of the rolling mill, before they are welded to form a continuous strip.

Historically, coiled tubing is made of strips of material that are already processed to possess most of the desired mechanical properties of the final pipe product. When these strips are joined via bias welds and then seam welded into the tube, the mechanical properties will be different at the weld locations (e.g., due to the material modifications at the welds). The base material itself may also have intrinsic variation in properties due to the productions methods, wall thickness, and material chemistry. This produces a finished coiled tubing string with non-uniform properties (particularly at the weld areas). This variation in properties may cause locations of stress concentration during use, leading to potential failure. A coiled tubing string without these heterogeneous properties zones will experience more reliable performance.

A method of continuous and dynamic heat treatment of coiled tubing is described in prior art patent US20140272448A1. US20140272448A1 discloses a method of manufacturing a coiled tube with improved properties, both in microstructure and mechanical properties, along the length of the CT as a result of minimizing or eliminating heterogeneities caused by the different welding processes. The goal of this process is to produce a homogenous microstructure composed of for example tempered martensite.

Other prior art methods and systems used for continuous heat treatment of coiled tubes and wires are known. However, these prior art methods and systems disclose and teach using only one heat treatment process (e.g. annealing) at a time. An example of such prior art is U.S. Pat. No. 5,328,158. This prior art patent describes an apparatus that heat treats coiled tubing while the pipe is continuously advanced in and out of a heat treating furnace. However, the tube is coiled inside the furnace, which causes bending to be induced both at the entry and at the exit of the furnace. The tube can only experience one heat treatment process at a time (e.g., annealing, quenching, tempering). Such a prior art system presents a problem for producing a product with homogeneous Yield Strength (YS) along its length. When the wall thickness (WT) or steel chemistry changes (even marginally) the furnace will be slow to react or not react at all. If the furnace stays at the same temperature, an increase in wall thickness can result in a lower tube temperature and therefore an increase in yield strength. Similar variation would be expected due to steel chemistry changes from strip to strip. If the furnace was equipped with the ability to adjust to the temperature requirements for different strips in a CT string, it would still not be able to react immediately, causing areas of the pipe that are heat treated at too high and too low temperatures during the transition.

It is desirable to provide a new system and new method of process control for heat treatment in which the coiled tube is unspooled, heat treated, and re-spooled (e.g. multi-stage heat treating in a continuous process).

When producing a standard coiled tubing with a desired mechanical property, uncontrolled variations in the wall thickness, chemistry of the raw material, introduced variation in wall thickness during design (tapers), variations in pipe speed, etc. could introduce variations in the resulting properties of the pipe. This prior art process may create a homogenous tube with respect to microstructure but the tube will have non uniform mechanical properties if the process is not properly controlled.

Mechanical properties (i.e., yield strength) resulting from a heat treatment process primarily depend on the ability to control temperature. When processing a coiled tube the linear speed varies throughout the production run. Steel chemistry varies between strips, even while inside the accepted limits this variation can lead to substantial changes in the resulting mechanical properties. Wall thickness, similarly, varies between strips causing the tube to respond differently to heating. These factors combined to produce a significant amount of natural variation within the process.

Because of this, the coiled tubing product exhibits a statistically wide distribution of mechanical properties.

SUMMARY

A method and system for manufacturing coiled tubing using a feed forward control loop for heating a continuously moving tube is disclosed. This method and system includes process control for heat treatment in which the coiled tube is unspooled, heat treated, and re-spooled (e.g. multi-stage heat treating in a continuous process).

This method and system also provides a control system for manufacturing coiled tubing that will produce uniform mechanical properties along the length of the coiled tube.

Heat treatment of coiled tubing is performed as a substantially continuous process in which the coiled tubing is moved through a series of heating stations/zones that are operated at power levels that are based on the mass flow of the tubing to be heated. The tube is heated in order to obtain a target temperature that is based on the dimensions of the heat treatment line (e.g. the size of the heat treatment line affects the cooling distance/time, the heating rates, etc.), the actual material chemistry, the tubing wall thickness, and the desired properties of the resulting tube. Hence, although some metallurgical aspects of the tube can be controlled (e.g., in terms of time and temperature if a Hollomon Jaffe equation is used for example), the actual degree of control used for the variables of a selected heat treatment technology and specific products are generally less obvious.

In a first aspect, a system includes a feeder configured to feed a continuous length of a tube at a predefined rate, a speed sensor configured to determine an actual feed rate of the continuous length of the tube, a first geometry sensor configured to determine one or more geometric dimensions of a portion of the continuous length of the tube, a first treatment station comprising a first entrance, a first exit, and at least a first heat treatment zone therebetween, the first heat treatment zone comprising at least one first zone heating element, and a controller configured to power the first zone heating element at a first heat treatment power level based on a first heat treatment target value, the actual feed rate, one or more of the geometric dimensions, and a first heating element value of the first zone heating element.

Various embodiments can include some, all, or none of the following features. The first heat treatment target value can be based on one or more tube chemistry values. The system can also include a first temperature sensor configured to measure a first temperature of the tube at the first entrance, wherein the first heat treatment power level is further based on the first temperature. The system can include a second temperature sensor configured to measure a second temperature of the tube at the first exit, wherein the first heat treatment power level is further based on the second temperature. The first heat treatment station can include a second heat treatment zone and a temperature sensor between the first heat treatment zone and the second heat treatment zone. The first treatment station can be an austenitizing station. The system can include a second treatment station having a second entrance, a second exit, and at least one additional heat treatment zone therebetween, the at least one additional heat treatment zone having at least one additional heating element, and an additional temperature sensor configured to measure a temperature of the tube at the second entrance to the second heat treatment zone, wherein the controller is further configured to power the at least one additional heating element at a second treatment station power level based on a second treatment station target value, the feed rate, one or more of the geometric dimensions, a heating element value for the additional heating element of the second treatment station, and the second temperature. The second treatment station can be a tempering station. The second treatment station can also include another additional heat treatment zone having another additional heating element. The system can include a straightener configured to uncoil a coil of the tube prior to the portion entering the first treatment station. The system can include a coiler configured to bend the continuous length of tube into a coil. The system can include a speed sensor configured to determine an actual feed rate of the continuous length of the tube, wherein the first heat treatment station power level is based on the actual feed rate. The system can also include a third treatment station disposed between the first treatment station and the second treatment station, said third treatment station can be a quenching station having a first entrance, a first exit, and at least a cooling zone therebetween and configured to cool the portion.

In a second aspect, a method for the heat treatment of tubing includes receiving a continuous length of a tube, receiving a first heat treatment target value, feeding the continuous length of the tube at a predetermined feed rate, determining one or more geometric dimensions of a portion of the continuous length of the tube, determining a first heat treatment temperature based on the first heat treatment target value, determining a first treatment station power level based on the first heat treatment temperature, the actual feed rate, one or more of the geometric dimensions, and a first heating element value of a first heating element, powering the first heating element at the first treatment station power level, feeding the tube through a first heat treatment station having a first entrance, a first exit, and the first heating element therebetween, and heating the portion of the tube to the first heat treatment target value prior to the selected portion exiting the first treatment station.

Various implementations can include some, all, or none of the following features. The method can include measuring, after heating, a first temperature of the tube, determining a second treatment station power level based on the first temperature, the first heat treatment temperature, the feed rate, one or more of the geometric dimensions, and a second heating element value of a second heating element, powering the second heating element at the second treatment station power level, and heating the portion of the tube to a second heat treatment target value prior to the selected portion exiting the first treatment station. The method can include receiving one or more tube chemistry values, wherein determining the first treatment power station level is also based on the one or more of the tube chemistry values. The method can include determining a first temperature of the tube at the first entrance, wherein determining the first treatment station power level is further based on the first temperature. The method can include measuring a second temperature of the tube at the first exit, wherein the first treatment station power level is further based on the second temperature. The method can include quenching the tube to cool the portion to a predetermined quenching temperature after the portion exits the first treatment station. The method can include receiving a second heat treatment target value, determining a second heat treatment temperature based on the second heat treatment temperature, feeding the tube through a second treatment station comprising a second entrance, a second exit, and a second heat treatment zone therebetween, the at least one additional heat treatment zone comprising at least one additional heating element, determining a second temperature of the tube at the second entrance, determining a second treatment station power level based on a second heat treatment temperature, the feed rate, one or more of the geometric dimensions, a second heating element value of at least one additional heating element, and powering the at least one additional heating element at a second treatment station power level based on a second heat treatment target value, the feed rate, one or more of the geometric dimensions, a heating element value for the additional heating element of the second heating station, and the second temperature, and heating the portion of the tube to the second heat treatment target value prior to the selected portion exiting the second heat treatment station. The method can include measuring, after heating the portion of the tube to the second heat treatment target value, a third temperature of the tube, and heating the portion of the tube to a third heat treatment target value prior to the selected portion exiting the second heat treatment station. The method can include cooling the portion to a predetermined temperature. The cooling can include receiving a cooling treatment target value; determining a cooling treatment temperature based on the cooling treatment target value; feeding the tube through a third treatment station comprising a second entrance, a second exit, and at least one cooling treatment zone therebetween; cooling the portion of the tube to the cooling treatment target value prior to the selected portion exiting the third treatment station. The method can include straightening a coil of the tube prior to the portion entering the first treatment station. The method can include bending the continuous length of tube into a coil. The method can include determining an actual feed rate for the continuous length of tube, wherein the first treatment station power level is further based on the actual feed rate.

BRIEF DESCRIPTION OF DRAWINGS

Like reference symbols in the various drawings indicate like elements.

DETAILED DESCRIPTION

Generally speaking, the goal of the heat treatment control provided by the processes described herein is to produce a coiled tubing with substantially uniform properties within a very narrow range of tolerances. In some implementations, the value of the resulting product can be increased by narrowing the range of resulting mechanical properties (e.g., yield strength along the length of the tube), since the mechanical properties can define certain tube/pipe performance traits of value.

Figure 1:
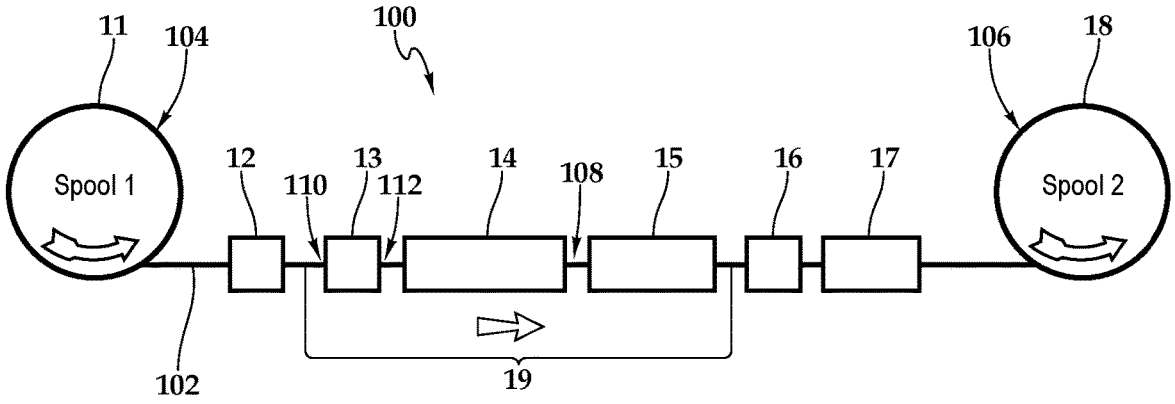
FIG. 1 is a block diagram that shows an example of a system heat treating straightened coiled tubing.

A process 100 of dynamic heat treatment is illustrated in FIG. 1. In general, the process 100 processes a tube 102 by unspooling a coiled section 104 of the tube 102 from a spool 11 into a straightened section 19 that passes through a collection of heat treatment process stages in a substantially continuous process, and the treated portion of the tube 102 is re-spooled onto a spool 18 as a coiled section 106.

During the process 100, the tube 102 is uncoiled from the spool 11 through a tube straightener 12 to form a first end of the straightened section 19. The tube 102 is then passed sequentially through a tube heating station 13 (e.g., an austenitizing stage), a tube quenching station 14, and a tube tempering station 15. Each of the stations 13-15 includes an entrance where the tube 102 enters the station, and an exit where the tube 102 leaves the station. For example, the tube heating station 13 includes an entrance 110 and an exit 112, with a heating element (not shown) in between. Small pipe distortions (e.g., caused by the heat treatment process) in the tube 102 is then adjusted by a tube sizing station 16 before passing through a tube cooling station 17. The heat-treated and cooled tube 102 is then re-coiled onto the spool 18 in the coiled section 106.

Figure 2:
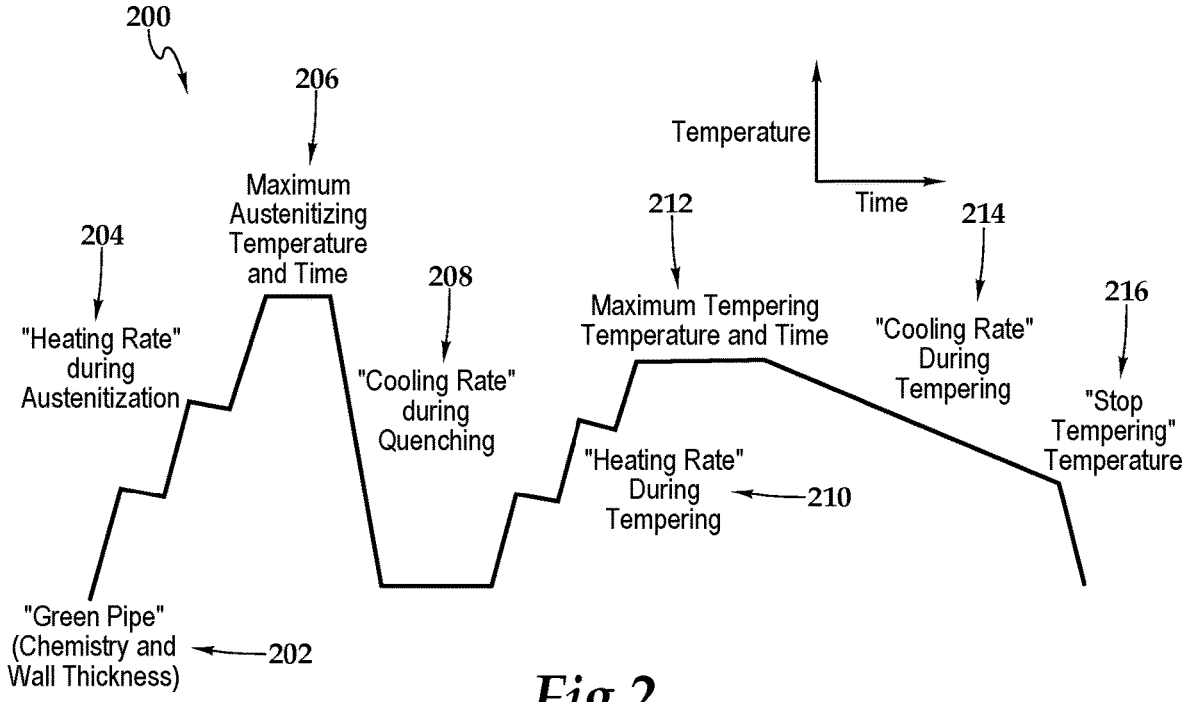
FIG. 2 is graph that shows an example of time-temperature variations during coiled tubing heat treatment.

Although there are a number of potential configurations of the stations 12-17 that are possible, the processes performed by the tube austenitizing station 13, the tube quenching station 14 and the tube tempering station 15 could be generalized with a schematic in terms of temperature-time variations as shown in FIG. 2.

FIG. 2 is a schematic 200 of time-temperature variations during coiled tubing heat treatment by a process such as the example process 100 of FIG. 1. In this example, the process may be an austenitizing process followed by quenching and tempering. In FIG. 2 the initial "green pipe" is treated through a series of heating stations (e.g., two in this example although this number could change) and other stations (e.g., quenching stations, tempering stations), that can be separated by gaps that provide a short period of cooling between heating stations. In some embodiments, the number and arrangement of the stations 12-17, sizes and quantity of gaps could be modified to alter the process (e.g., between heating stations, between heating and cooling stations and between cooling stations at different cooling rates).

At a stage 202, the tube is in a pre-treated, "green pipe" condition with regard to various variable properties, chemistry and wall thickness, that can be relevant for subsequent processing steps. At a stage 204, the tube 102 is heated to a predetermined temperature of austenitization (e.g., in case the heat treatment process requires this before quenching) and held at this temperature for a predetermined holding time during a holding stage 206 at this temperature. In some implementations, this holding stage 206 could hold the tube 102 at a substantially constant temperature or at a slow cooling rate, provided the initial transformation is not started before a fast cooling process is applied during a quenching stage 208. In some implementations, the stages 202-206 could be performed in the heating station 13 of FIG. 1. In the example schematic 200, the stage 204 is illustrated with the heating being performed in three stages. In some implementations, the stages 202-206 could be performed multiple times within the heating station 13. For example, the heating station 13 can include three or any other appropriate number of heating zones (e.g., each having one or more heating elements) to heat the tube 102 in two, three, or more increments before being processed through the quenching stage 208.

The cooling rate of stage 208 is identified as a cooling rate that is greater than a predetermined critical value for the material (e.g., to promote the desired transformation). In some implementations the cooling rate can be constant, or it may be variable. In some implementations, the temperature at the exit of quenching may be substantially equal to the ambient temperature, or it may be a different temperature. In some implementation, the stage 208 may be performed in the quenching station 14 of FIG. 1.

Similar processes may be applied to subsequent tempering cycles, although the predetermined temperature may be lower (e.g., no austenitization). For example, the tube can be re-heated during a tempering stage 210 until a predetermined tempering temperature is reached and maintained for a predetermined time at a stage 212. In the example schematic 200, the stage 210 is illustrated with the heating being performed in multiple stages by multiple heating zones. At the exit of the tempering stage 212, the tube is cooled during a stage 214 at a controlled rate until a predetermined temperature is reached at a stop point 216. In some implementations, the controlled cooling rate can affect the resulting mechanical properties of the tube. In some implementations, the stages 210-216 can be performed by the tube tempering stations 15 and 17 of FIG. 1. In some implementations, the heat treatment process 100 could require a combination of one or more quenching (Q) and tempering (T) configurations, such as Q+T, Q+Q+T, Q+T+Q+T, Q+T+T, etc.

In some implementations, there may be certain metallurgical characteristics that can define the final mechanical properties of the tube based on this thermal cycle. For example, one of the metallurgical properties affected by the configuration of the process 100 can be the austenitic grain size that results from the austenitization process (e.g., a combination of soaking temperature and time, the heating rate, and/or the cooling rate). A narrow control of this process can result in a well-defined material going into the quenching and subsequent tempering stages. In another example, another one of the metallurgical properties affected by the configuration of the process 100 can be the starting microstructure and properties of the tube before tempering, which can be affected by the degree of quenching. In another example, the characteristics of the tempering cycle can be based on a combination of the heating rate, the soaking temperature and time, and the cooling rate (e.g., as in the case of austenitizing).

In some implementations, the relationship between the starting material properties after quenching and the final mechanical properties after tempering with a certain tempering cycle can be predicted. For example, the actual time-temperature cycle may be determined by using a Hollomon-Jaffe type of equation. In some implementations, the knowledge used to apply this concept industrially may require an understating of the complexities of the particular heating technology (e.g., induction or gas fired furnace, continuous or batch) as well as the tube's characteristics (e.g., chemistry, diameter, wall thickness) that may affect the thermal cycle and/or the material response to such cycles.

Figure 3:
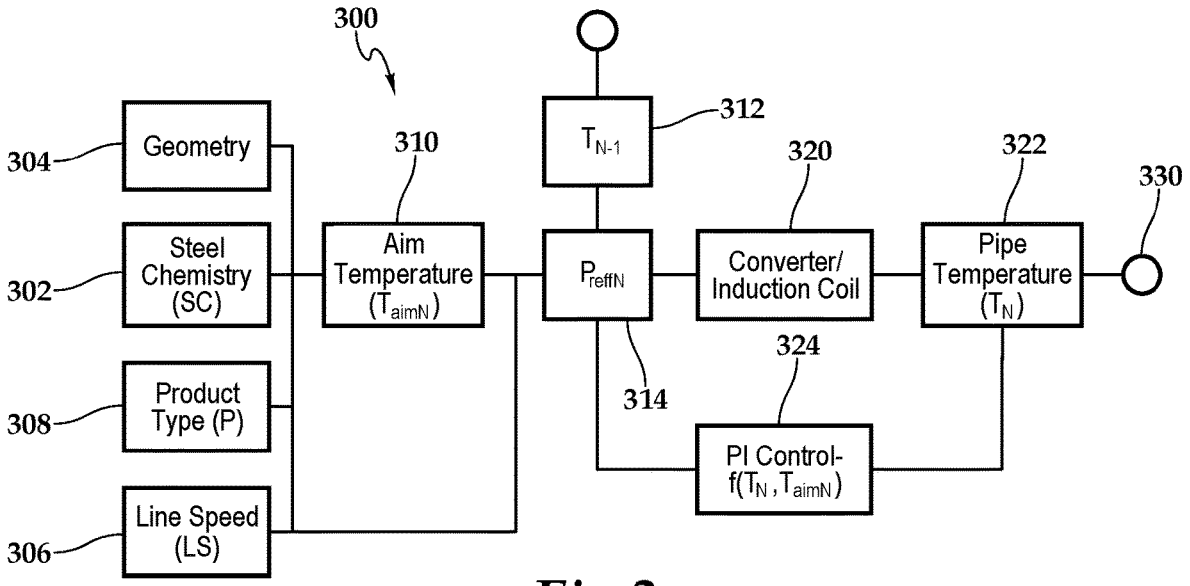
FIG. 3 is a block diagram that shows an example control flow for the production of coiled steel tubing.
Figure 4:
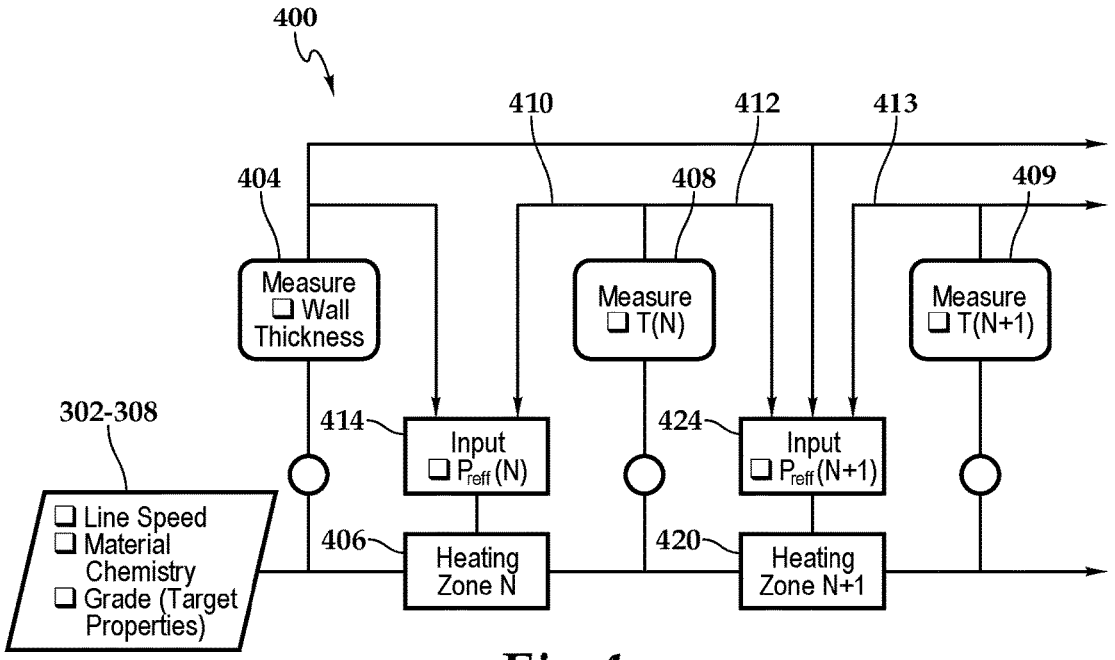
FIG. 4 is a block diagram that shows example variables used in an example control process for the production of coiled steel tubing.

Referring now to FIGS. 3 and 4, the continuous nature of a coiled tubing product can be addressed by using continuous heat treating process, such as the example process 100 of FIG. 1. FIG. 3 shows a process control flow chart 300 for a heating element (e.g., a heating element within the heating station 13) of a continuous heat treating process (e.g., the process 100). FIG. 4 shows a process control flow chart for a continuous heat treating process 400 for a tube heating or tempering station having multiple heating elements (e.g., the multiple heating increments of stage 204 of FIG. 2). In some implementations, the process 400 can be implemented as part of the process 100. For example, the process 400 can be implemented by moving the coiled tubing through a series of heating zones within heating stations such as the heating station 13 and/or the tempering station 15, as illustrated by the example process 100 of FIG. 1. In another example, the process 400 can be performed by one or more than one of the stations of FIG. 1 (e.g., process 400 could be performed by the heating station 13 and again by the tempering station 15). The process 400 includes a number of heating zones (e.g., each having one or more heating elements), and in some implementations, the number of heating zones ("n") can vary and can be based on the power capabilities, the heating efficiency desired, and/or the process control strategy. In the case of the coiled tubing 102, a number of treatment zones (e.g., at least 2) are used in order to provide opportunities for early detection of tube 102 metallurgical properties that can provide feedback for adjusting heat set points in subsequent heating zones to obtain the desired mechanical properties of the coiled tubing 102.

Referring to FIGS. 3 and 4, the disclosed control flow chart 300 and the process 400 are based on a collection of input variables. A collection of steel chemistry (SC) input values 302 and a collection of geometry input values 304 (e.g., diameter, wall thickness) of the strip used to build the coiled tubing string are received. A line speed input value 306 (e.g., the speed at which the tube passes through the process 100) and a collection of heating product input values 308 (e.g., the final product type, a desired final mechanical property, a description of the temperature set points, heater types, heater geometries used in the process 100) can be combined to describe and/or determine the lengths of time of each heating-cooling stage.

The material (e.g., steel) chemistry input values 302 are known prior to processing (e.g., they can be provided by the tubing supplier). In some implementations, the material chemistry of the tube 102 may be specified to fall within a predetermined range, and the variations within this range could result in a product with a 16 or more ksi range of yield strength from the lower accepted range of the steel chemistry to the upper accepted range of the steel chemistry. In some implementations, the material chemistry input values 302 can include a description of the chemistry of alternative parameters such as carbon equivalent, Ti/N ratio, and any other appropriate chemical characteristics of the steel. This chemistry information can be used to define a target power reference for the heating system (e.g., with one or more sections/zones), and this power reference can be modified using a scaling factor from the line speed input value 306 and geometry input values 304.

The geometric property input values 304 describe geometric values of the tube 102 (e.g., length, diameter, tube wall thickness). The geometric property input values 304 are generally known prior to the start of the heat treatment process 100, and these geometry values are used as the geometry input values 304 to the process control logic. In some implementations, the actual geometric dimensions of the tube 102 can be determined explicitly. For example, the actual wall thickness of the tube 102 can be measured using ultrasonic technology, Hall Effect sensors, or any other appropriate contacting or non-contacting process for measuring the geometric properties of the tube 102. In some implementations, such devices may be left offline if desired (e.g., depending on the effect of such measurement on final pipe properties), and a predetermined value may be used instead (e.g., manufacturer's specifications). In some implementations, the geometry input 304 can be updated periodically or continuously, and can be used to update the control system on a periodic or continuous basis.

In some embodiments, the wall thickness in a typical coiled tube may vary by several thousandths of an inch. This variation is generally increased substantially more when a taper transition is considered, for example, from 0.190 in to 0.204 in (4.826 mm to 5.182 mm). Such wall thickness variations do not cause the target temperature, which is based on a tempering model that uses accepted techniques to achieve the desired mechanical properties in the output product, to vary substantially. For example, in the case of a taper transition from 0.190 to 0.204 in (4.826 mm to 5.182 mm), the target temperature for a 110 ksi grade (759 kPa) product may only vary up to 2 degrees C. In some implementations, significant impact on the product properties may not come mainly from the target temperature, but rather from the response of the thinner or thicker material to the heating process. For example, if all variables remain constant and the thicker material is heated in the same equipment with the same power output, the resulting temperature of the CT will be lower. This lower temperature can cause a higher yield strength in the coiled tubing at the taper transition. For example, the mechanical properties of steel after tempering can increase as temperature decreases. Hence a thicker section, heated to a lower temperature, can have a higher yield strength.

In some embodiments, the process of welding bias welds along the coiled tubing string can change the material chemistry and wall thickness, sometimes significantly, for example in the case of a tapered string. Such changes are accounted for in the process 300 detailed herein. For example, in the case of a wall thickness change within a predetermined expected tolerance range for a straight-walled tube, the bias weld will be detected prior to entering the tube heating station 13 of FIG. 1. The wall thickness measurement can be used as part of the geometry input values 304 to adjust the amount of power applied to a subsequent heating stage. A feed-forward control system will also adjust the power references of subsequent heating zones to compensate for the wall thickness's effect on the resulting temperature. The temperature will stabilize to the target temperature quickly while the bias weld is passing through the heating zone. Similar control will be executed when changes in material chemistry are experienced.

Referring now to FIG. 4, the wall thickness and/or other variables of the geometry input values 304 of the tube 102 are determined during a geometric measurement process 404. The geometric measurement process 404 is performed in real time at the entrance to a first heating (austenitizing) zone 406 (e.g., at or near the entrance of the tube heat treatment station 13 and/or the entrance of the tube tempering station 15) as part of determining the geometry input values 304. This live wall thickness reading, including weld thickness, is used as part of a process to update a power reference value ($P_{reffN}$) 414 for the heating zone 406. The combination of the material chemistry input values 302, the line speed value 308, and the product geometry input values 304 are fed into a model that calculates a target temperature for the tube 102. The reference power value 414 is calculated using the model-derived target temperature and the line speed input value 306.

The heating zone 406 is set to the calculated reference power value 414 ($P_{reffN}$). As the tube 102 passes through the heating zone 406, the tube 102 increases in temperature. In some implementations, the heating zone 406 can perform at least a portion of an austenitizing process. A temperature measurement process 408 monitors the temperature of the tube 102 at the exit of the heating zone 406 (e.g., by pyrometers, thermal imagers, thermocouples). The temperature reading is used to backwardly close the control loop (e.g., a feedback line 410) by comparing the tube temperature measured at 408 with the target temperature for the heating zone 406. The measured temperature is compared with the model-derived target temperature, and the control loop uses the difference between the target and measured temperatures to modify the power reference value 414 in accordance with the austenitizing process. This difference closes the control loop by adjusting the first zone's power reference value 414 ($P_{reffN}$).

In some embodiments, the temperature that corresponds to the modified power reference value 414 can be achieved quickly, and variations in the material of the tube 102 can be compensated for, yielding a homogeneous high-quality product. In some implementations, this can reduce the chances of a single section of the tube 102 being heat treated to an incorrect temperature. The nature of the product is such that a section with incorrect properties might concentrate deformation (e.g., if yield strength is relatively lower than in surrounding sections) or result in a relatively stiff section that can concentrate deformation in an adjacent zone (e.g., if yield strength is relatively higher than in surrounding sections).

The temperature measured at 408 is also fed forward (e.g., a line 412) to the next heating zone, illustrated in FIG. 4 as a heating zone 420. In some implementations, the heating zone 420 can perform a treatment process or be part of a treatment zone (e.g., heating zone 13 or tempering zone 15). A power reference value 424 ($P_{reffN+1}$) for the heating zone 420 is determined based on the input values 302-308, the wall thickness measured at 404, and the temperature measured at 408. The difference between the target and measured temperature at the exit of the heating zone 406 (e.g., heating zone N) is used as an input to set the reference power of the heating zone 420 (e.g., heating zone N+1). As during the austenitic heating process, the steel chemistry, product geometry, feed rate, tube temperature, and heater parameters are used to determine the initial power reference for the first heating zone. In some implementations, by using a feed forward approach, the target temperature is reached and variations in temperature due to different chemistry, wall thickness, etc. can be compensated for quickly.

A temperature measurement process 409 monitors the temperature of the tube 102 at the exit of the heating zone 420 (e.g., by pyrometers, thermal imagers, thermocouples). The temperature reading is used to backwardly close the control loop (e.g., a feedback line 413) by comparing the tube temperature measured at 409 with the target temperature for the heating zone 420. The measured temperature is compared with the model-derived target temperature, and the control loop uses the difference between the target and measured temperatures to modify the power reference value 424 in accordance with the austenitizing process. This difference closes the control loop by adjusting the first zone's power reference value 424 ($P_{reffN+1}$).

In some implementations, the measurement that is fed forward via line 412 may be a value measured by another temperature sensor. After the tube 102 is heated by the heating zone 406, the tube 102 then enters the heating zone 420. A temperature measurement of the tube may be taken at a point between the exit of the heating zone 406 and the entrance to the heating zone 420, and that measurement may be fed forward to determine a power level for heating the heating zone 420.

As the tube 102 is processed through the heat treatment process 400, there may be variations in the line speed input value 306 (e.g., linear speed of the coiled tubing) due to electrical fluctuations on drive motors, tension in the tubing, etc. Such variations in speed can cause variations in actual and target temperature, however, the target temperature does not vary substantially. Line speed variations cause changes in the resulting temperature of the tube 102. For example, with all heating variables held constant (e.g., power, frequency, equipment) a drop in linear speed may cause an increased temperature (e.g., due to increased time exposed to the heating equipment) which can result in a lower yield strength in the final product (e.g., in general, higher temperatures can lower the yield strength properties after tempering, although some steels can exhibit different behaviors).

In some implementations, the line speed can be measured using an encoder, laser device, camera, or any other appropriate technique for determining the linear speed of the uncoiled portion of the tube 102. Such measurements provide live speed information that is used as the line speed input value 306 for the control of the reference power value of each of the heating zones 406, 420. As such, variations in geometry (e.g., wall thickness), line speed, and/or material chemistry can be actively compensated in order to reduce their effect upon the mechanical properties of the tube 102 along the full length of the string. In some implementations, similar process control methods may be carried out for other types of heat treatments, such as normalizing, annealing, etc., as described herein for the austenitizing and tempering processes.

Referring again to FIG. 3, the control flow chart 300 illustrates an example control process for a single heating zone. For example, the control flow chart 300 can illustrate the process used to control the heating zone 406 and/or the heating zone 420 of FIG. 4.

A target output temperature value 310 describes a predetermined temperature, for example, a temperature used to perform a selected heat treatment operation such as austenitizing, tempering, or any other appropriate heat treatment operation.

A previous zone temperature value 312 describes the temperature of the tube 102 as it exited a previous treatment process (e.g., the measurement taken at 408 and fed forward to the heating zone 420). A reference power value 314 is determined based on the difference between the previous zone temperature 312 and the target output temperature value 310.

The reference power value 314 is used to configure (e.g., set an applied power to) a heating element 320. In some embodiments, the heating element 320 can be an induction heater, an infrared heater, or any other appropriate device that can heat the tube 102 to the target output temperature value 312. In some embodiments, the heating element 320 can be located between the entrance 110 and the exit 112 of FIG. 1. As the tube 102 is heated by and then exits the heating element 320, a tube exit temperature value 322 is measured. The tube exit temperature value 322 is fed backward to modify the reference power value 314 in a closed control loop based on a temperature differential value 324 between the target temperature value 310 and the tube exit temperature 322. The tube exit temperature 322 is also provided as an output value 330 for use by other heat treatment processes. For example, the output value can be the value fed forward on the line 412.

It will be understood that the feed forward control system as previously described in paragraphs with regards to treatment stations 13 and 15 (See FIG. 1) may also include one or more cooling stations configured for cooling (e.g., the quenching station 15 and/or the cooling station 17). The cooling stations may include cooling elements and/or ambient cooling. The cooling elements may be chillers, quenching tank(s), impingement spray fluid nozzles, and other cooling systems known in the art. In some implementations, the amount of cooling action provided by the cooling stations may be determined based on a predetermined target cooling temperature and a measured temperature (e.g., measured during the temperature measurement process 409).

Figure 5:
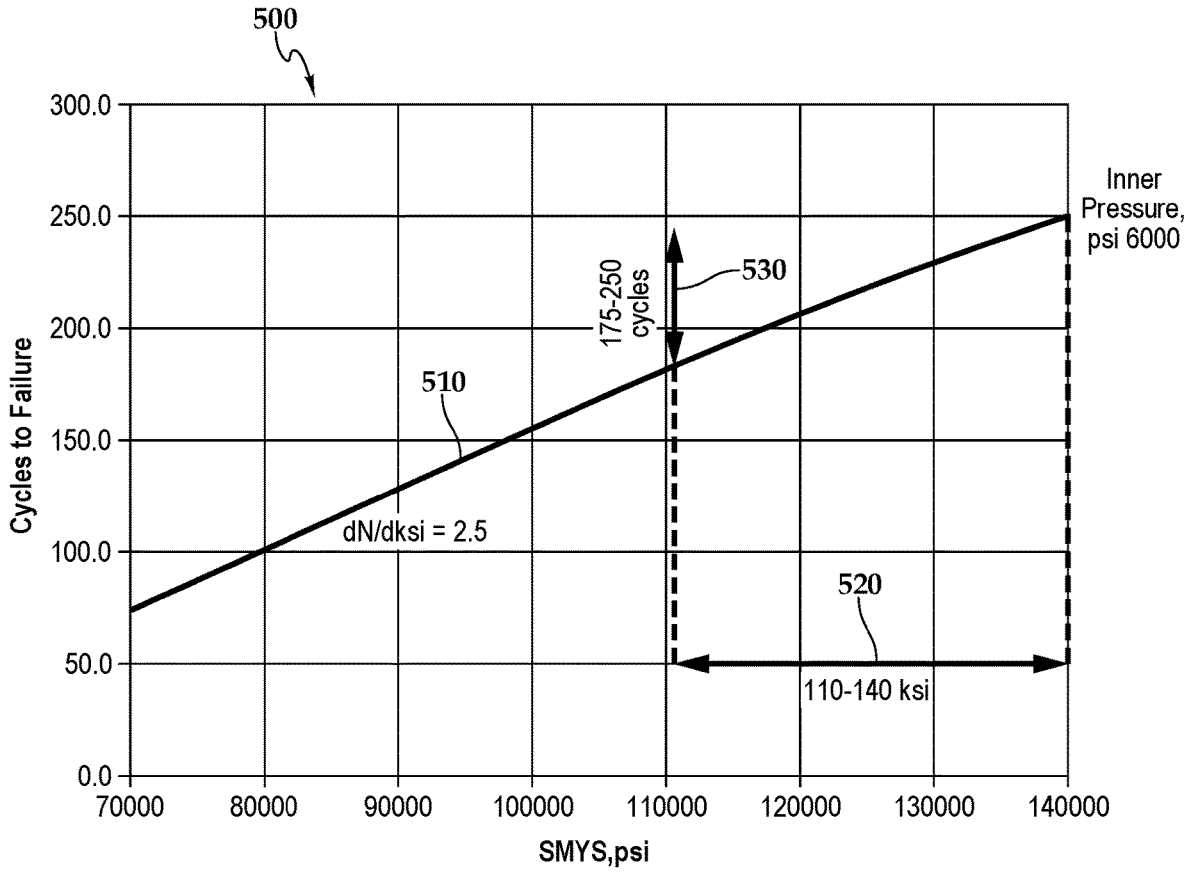
FIG. 5 is a chart that shows an example fatigue test.

FIG. 5 is a chart 500 that shows the results of an example fatigue test. In the fatigue test, coiled tubing was subjected to fatigue testing under pressure. The number of cycles to failure is related, among other variables, to the hoop stress that is produced by the internal pressure for a given material used in the construction of the tube, or is related to the variations in yield strength when a tube is tested under a constant pressure since this will translate into varying hoop stresses relative to the actual yield strength of the tube. The chart 500 illustrates the variation of the number of cycles to failure as a function of specified minimum yield strength (SMYS) (e.g., for steel pipe manufactured in accordance with a listed specification). For example in a 110 ksi (759 kPa) pipe of having an outside diameter (OD) of 2 inches (50.8 mm), a wall thickness (WT) of 0.204 inches (5.182 mm), and a curvature radius of 48 inches (1.2192 m), the change in cycles to failures at an intermediate pressure, for example at 6000 psi (41368.5 kPa), is:

dN/dYS (YS=110 ksi)=2.5 cycles per psi

As represented by a line 510.

In examples in which the yield strength of the product is defined with a scatter of +/−15 ksi, then the average YS will be 125 ksi (862.5 kPa) (e.g., as indicated by the 110 (759 kPa)-140 ksi (966 kPa) range 520) and the cycles to failure can range from 175 to 250 cycles (e.g., as represented by the range 530), representing a +/−17% error on actual fatigue life.

In some situations, if a producer of coiled tubing cannot not guarantee the properties to a sufficiently narrow range, the end user of the product may have to take a conservative approach for fatigue life, for example by retiring the product from operation prematurely. However, by using the heat treatment system and method of this disclosure it may be able to produce a product with the properties within a narrow range, the end user may be able to benefit by being able to use the product for its full, relatively longer fatigue life, thus increasing the value of the product.

In some situations, coiled tubing can be subjected to collapse, and the collapse pressure can be sensitive to the mechanical properties of the tube. As such, in some applications it may be desirable to control the yield strength in order to increase the collapse pressure for such a particular material composition. In scenarios in which a producer of coiled tubing cannot guarantee the properties to a sufficiently narrow range, the user of the product may have to take a conservative approach for collapse, for example by compensating with increase in wall thickness (increasing weight). However, by using the system and method of this disclosure, the user may benefit by being able to guarantee the properties within a narrow range, the end user may be able to use a relatively thinner and lighter tube for the same application, thus increasing the value of the product.

In some situations, coiled tubing is used in a well that has hydrogen sulfide ($H_2S$) present (referred to in the art as sour service). Performance in sour service (sour performance) is generally improved as the yield strength is decreased. The guarantee that a product will be able to withstand certain sour environments depends on the process capability to produce a product with sufficiently narrow properties. When a producer of coiled tubing cannot guarantee the properties to a sufficiently narrow range, the user of the product may have to take a conservative approach with respect to sour resistance, reducing the specified mechanical properties and compensating with increase in wall thickness (increasing weight). However, by using the system and method of this disclosure, the user may benefit by being able to guarantee the properties within a narrow range, the end user may be able to use a relatively thinner and lighter tube for the same application, thus increasing the value of the product.

EXAMPLES

Examples are provided that show control of the heat treating process during the manufacture of coiled tubing to provide uniform mechanical properties. The inputs for the process control include:

- Steel chemistry (of every strip used to build the coiled tubing string) (e.g., chemistry input values 302)
- Steel wall thickness (of every strip used to build the coiled tubing string) (e.g., geometry input values 304)
- Line Speed (e.g., the line speed value 306)
- Heating Technology (Total length for each heating-cooling stage) (e.g., heating product input values 308)
- The output temperature for a given applied power, or the required power for a target temperature) (e.g., the target temperature 310)

Example: Power Control to Obtain a Precise Target Temperature

Figure 6:
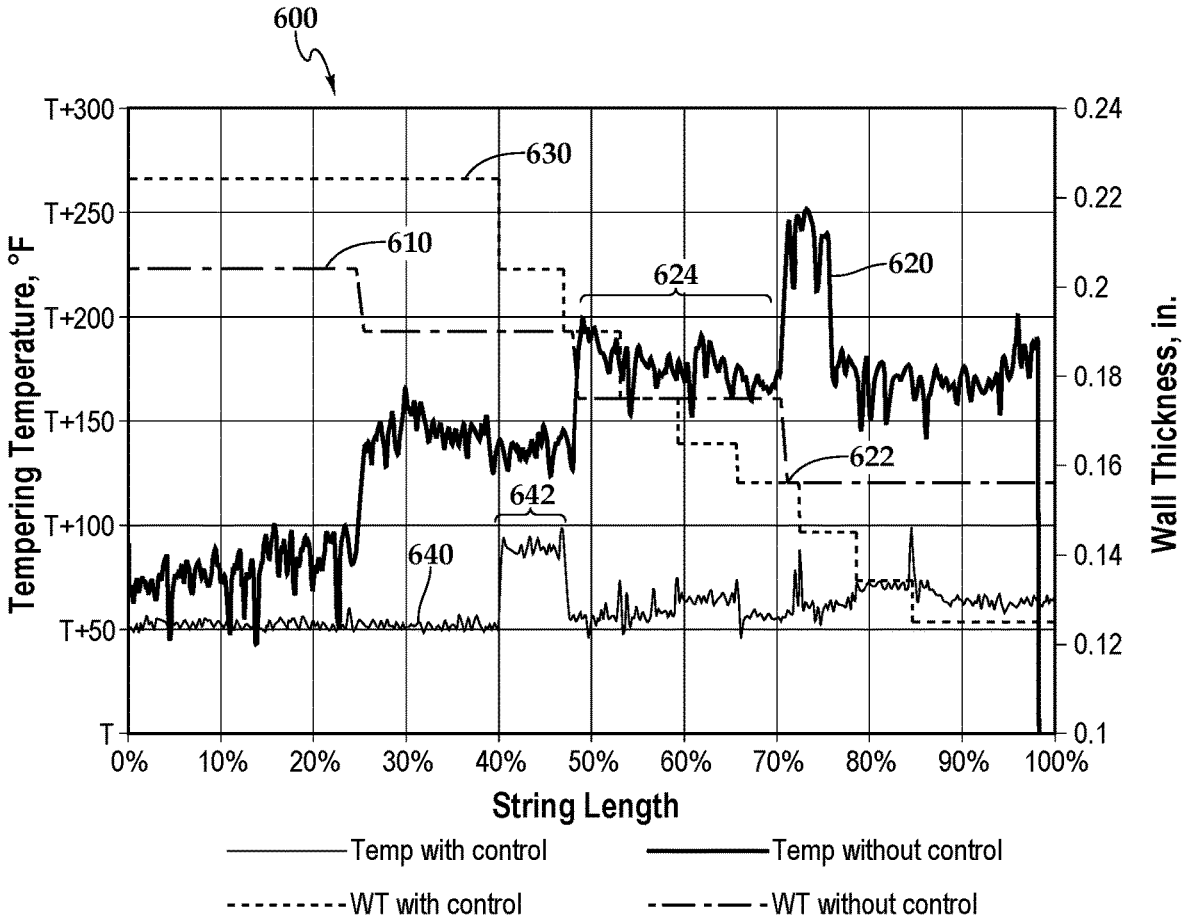
FIG. 6 is a chart that shows example changes in temperature under controlled and uncontrolled austenitizing process.

FIG. 6 is a chart 600 that illustrates changes in temperature due to wall thickness variation under controlled and uncontrolled austenitizing processes. The chart 600 shows the changes in temperature readings at the exit of the heating zones after two coiled tubes with various gauge changes are processed through an austenitization line (e.g., the process 100).

In this example, the objective is to produce a string with substantially uniform chemistry among strings of different wall thickness. For example, if the heating power is held constant when a given change in wall thickness approaches the heating zone, there will generally be a change in output temperature that can be related to the change in mass associated to the new wall thickness, but in reality it can also depend on the effectiveness of the heating device(s) being used. Once the relationship between power and temperature for a given pipe dimensions is calibrated, the uniformity of the temperature can depend on the system's capability to detect the change in wall thickness and apply the necessary power adjustments in a manner that aligns temperature changes with corresponding locations along the tube.

In a "without control" example, the line is run at constant power. As the wall thickness decreases (line 610), the temperature increases (line 620), until the wall thickness reaches 0.156 in (3.9624 mm) (at 622, at approximately 70% of string length), at which point a manual adjustment of power was introduced in order to reduce the temperature to the 0.175 in (4.445 mm) equivalent (region 624).

In a "with control" example, a larger change in wall thickness than in the "without control" example is introduced (e.g., from 0.224 in to 0.125 in) and is processed through the same production line, however a detection system for wall thickness changes as well as process control strategy as described above is implemented. In the first 20% of the string, the chart 600 illustrates than even at constant nominal wall thickness (line 630), the control of temperature (line 640) can be improved (e.g., more stable compared to line 620), showing that a power control strategy can improve a heat treatment process even when the tube has a substantially constant wall thickness.

In the illustrated example, the power control was turned off at 40% (at 642) to make evident the temperature jumps that could be expected in the "without control" example. The control system was turned back on at 47% of the string and was left on for the remainder of the string. Under the process control as described in this application, the variations in temperature were reduced 83% with respect to the change observed in the non-controlled example. Although the "with control" example shows variations of wall thickness from thick to thin, the system can work in both directions of changes in wall thickness (e.g., thin to thick, steady or randomly varying thickness).

Figure 7:
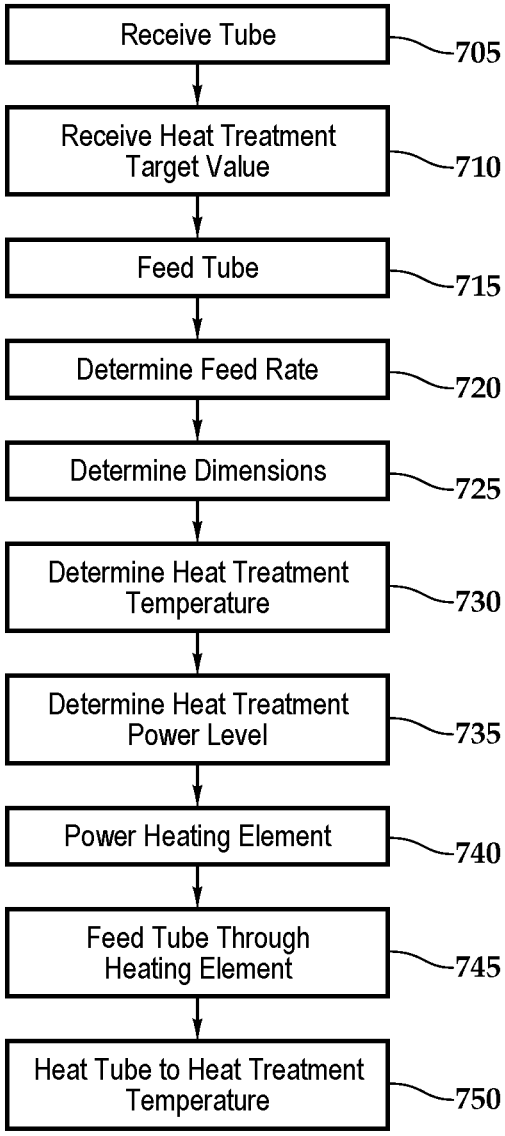
FIG. 7 is a flow diagram of an example process for the production of coiled steel tubing.

FIG. 7 is a flow chart of an example process 700 for heat treatment. In some implementations, the process 700 can be used to perform the example process 100 of FIG. 1 and/or the process 400 of FIG. 4. In some implementations, some or all of the process 700 may be performed by the example heating station 13 and/or the example tempering station 15 of FIG. 1.

At 705 a continuous length of a tube is received. For example, the tube 102 is provided on the spool 11 prior to being heat treated.

At 710, a first heat treatment target value is received. For example, the process 100 may be configured to impart at predetermined property (e.g., a specified yield strength) into the tube 102.

At 715, the continuous length of the tube is fed at a predetermined feed rate. For example, the tube 102 can be moved sequentially through the tube heating station 13, the tube quenching station 14, and the tube tempering station 15 at a predetermined linear speed.

At 720 an actual feed rate of the continuous length of the tube is determined. For example, variations in the line speed input value 306 (e.g., linear speed of the coiled tubing) due to electrical fluctuations on drive motors, tension in the tubing, etc., can cause the actual linear speed of the tube 102 to differ from the predetermined feed rate. To compensate for these variations, the line speed can be measured using an encoder, laser device, camera, or any other appropriate technique for determining the actual linear speed of the uncoiled portion of the tube 102.

At 725, one or more geometric dimensions of a portion of the continuous length of the tube are determined. For example, the outer diameter, the inner diameter, the wall thickness, or combinations of these and other dimensional features of the tube 102 may be measured.

At 730, a first heat treatment temperature is determined based on the first heat treatment target value. For example, a known yield strength value may be obtained by heating the tube 102 to a corresponding heat treatment temperature. In some implementations, the first heat treatment target value can be the first heat treatment temperature.

At 735, a first heat treatment power level is determined based on the first heat treatment temperature, the actual feed rate, one or more of the geometric dimensions, and a first heating element value of a first heating element. For example, a particular make, model, and heating technology used in the tube heating station 13 may achieve a particular heating temperature at a corresponding power level, therefore the power level selected for the tube heating station 13 is partly based on the heating technology in use. In another example, the faster the tube 102 is moving, the less time a particular portion of the tube 102 will spend heating up within the tube heating station 13, therefore the power level can be partly based on the feed rate. Similarly, in some examples, relatively higher power levels may be needed to heat relatively thicker and/or larger tubes than relatively thinner and/or smaller tubes to the same temperature during the same amount of time.

At 740, the first heating element is powered at the first heat treatment power level, and at 745 the tube is fed through the first heat treatment station having a first entrance, a first exit, and the first heating element there between. For example, the heating element(s) 320 of FIG. 3 can be powered at the first heat treatment power level to heat the tube 102 as it passes through the tube heating station 13 between the entrance 110 and the exit 112.

At 750, the portion of the tube is heated to the first heat treatment target value prior to the selected portion exiting the first heat treatment station. For example, the tube 102 can be heated by the heating element 320 to a predetermined temperature before the tube 102 passes out the exit 112.

In some implementations, one or more tube chemistry values can be received, and the first heat treatment power level can also be based on the one or more of the tube chemistry values. For example, different steel alloys used in the construction of the tube 102 can have different corresponding temperatures of austenitization.

In some implementations, a first temperature of the tube can be determined at the first entrance, and the first heat treatment power level can be based also on the first temperature. For example, a tube that is warm as it passes through the entrance 110 may need less of a temperature increase and therefore less heating power than a relatively colder tube. In some implementations, the temperature of the tube 102 can be measured at the entrance, and that value can be used as part of the process used to determine the power level selected for the heating element 320.

In some implementations, a second temperature of the tube can be measured at the first exit, and the first heat treatment power level can be based also on the second temperature. For example, the temperature measurement process 408 of FIG. 4 is performed after the tube 102 is exposed to the heating zone 406, and that measured exit temperature value can be fed back as part of determining the calculated reference power value 414. As such, the measured exit temperature value can be used in a closed-loop control system for controlling the amount of power used by the heating zone 406 and/or the heating element 320.

In some implementations, the tube can be quenched to cool the portion to a predetermined quenching temperature after the portion exits the first heat treatment zone. For example, at stage 204 of FIG. 2, the tube 102 can be heated to a predetermined temperature of austenitization before a fast cooling process is applied during a quenching stage 208.

In some implementations, some or all of the process 700 may be repeated any appropriate number of times. For example, the tube 102 may be heated, the temperature may be measured, and the tube 102 may be heated again and the temperature may be measured again, all within the heating station 13 and/or the tempering station 15 of FIG. 1.

In some implementations, some or all of the process 700 may be repeated within a selected treatment station. For example, the tube 102 may be heated by one or more heating elements within the heating zone 406, the temperature may be measured. That measurement may be fed back to control the amount of heating being provided within the heating zone 406, and the measurement may be fed forward to control the amount of heating to be provided by one or more heating elements within the heating zone 420. The tube 102 may be heated again by the heating zone 420 based on the second measurement, and the temperature may be measured again at the exit of the heating zone 420, all within the heating station 13 and/or the tempering station 15 of FIG. 1.

In some implementations, a second heat treatment target value can be received, a second heat treatment temperature can be determined based on the second heat treatment temperature, a second temperature of the tube can be determined at the second entrance, a second heat treatment power level can be determined based on a second heat treatment temperature, the actual feed rate, one or more of the geometric dimensions, a second heating element value of a second heating element, and the second heating element can be powered at a second heat treatment power level based on a second heat treatment target value, the actual feed rate, one or more of the geometric dimensions, a second heating element value of the second heating element, and the second temperature, the tube can be fed through a second heat treatment station comprising a second entrance, a second exit, and the second heating element, and the portion of the tube can be heated to the second heat treatment target value prior to the selected portion exiting the second heat treatment station. For example, the temperature of the tube 102 can be measured (e.g., the measurement 408) after being cooled in the quenching stage 208 and before being reheated during a tempering stage 210 (e.g., at the gap 108). This temperature measurement can be fed forward (e.g., via line 412) to be used in to determine the power reference level 424 using for the heating zone 420.

In some implementations, a predetermined cooling treatment target value can be received, a cooling treatment temperature can be determined based on the cooling treatment target value, the tube can be fed through a third treatment station having a second entrance, a second exit, and at least one cooling treatment zone therebetween, and the portion of the tube can be cooled to the cooling treatment target value prior to the selected portion exiting the third treatment station For example, the tube 102 can be cooled to a predetermined temperature by the quenching station 14 (e.g., during the quenching stage 208). In another example, the tube 102 can be cooled during the stage 214 at a controlled rate until a predetermined temperature is reached at the stop point 216. In some implementations, the amount of cooling provided to the tube 102 (e.g., chiller power, coolant flow rate) can be controlled based on a temperature measurement (e.g., the temperature measurement process 409).

In some implementations, a coil of the tube can be straightened prior to the portion entering the first heat treatment station. For example, the tube 102 can be provided on the spool 11 and straightened by the straightener 12 prior to the tube entering the entrance 110.

In some implementations, the continuous length of tube can be bent into a coil. For example, the tube 102 can be re-coiled onto the spool 18 after being heat treated.

Example: Variable Acquisition in Order to Define the Proper Target Temperature For the purposes of the temperature control processes described herein, the relevant variables that affect the mechanical properties and hence the target temperature for a given product can include one or more of:

- Chemical elements that are relevant for the process: In the case of quench and temper steels, the elements can include (in wt %): C, Si, Mn, Ni, Cr, Mo, Ti, N, B and V.
- Wall thickness: for example, changes of gauges at specific bias welds in the case of a tapered coiled tubing.

Heating technology (e.g., induction) and heating model: for example, to calculate one or more of the heating rates, heating sequence, maximum temperature, and the soaking time for the austenitizing and/or tempering process.

Quenching Model for the cooling device installed and the resulting cooling rates for different process conditions: for example, wall thickness, tube diameter, linear speed, water temperature, cooling length.

Power available per inductor and how does the power sequence is applied to the product while heating.

Material model for austenitic grain growth during austenitization and its effect on hardenability and final properties.

Material model for quenching: for example, in order to estimate the starting hardness of the tube as a result of a given cooling rate.

Material model for tempering: for example, in order to estimate the final properties as a function of the tempering cycle, such as the effect of the starting chemistry and precipitates status.

Example: Chemistry Effects

The steel specification for a particular steel is generally defined in ranges (e.g., minimum-maximum) for each coil, hence there is a potential for variation in the final mechanical properties if the target temperature is not modified to compensate for the effect of these chemistry variations. The temperature requirements for tempering can change with chemistry due to modification of the quench hardness as well as the tempering resistance of the material.

In some examples, the specification of a selected steel used for the production of coiled tubing can have variations in chemistry for each batch/coil. In some examples, each coil could vary as shown in the table below:

| | % of Chemistry Variations between minimum and maximum with respect to average. | | | | | Potential YS Variation for different YS targets (ksi) | | |
|---|---|---|---|---|---|---|---|---|
| | wt % C | wt % Si | wt % Mn | wt % Ni | wt % Cr | 100 ksi | 115 ksi | 130 ksi |
| According to Steel Specification | 16.0 | 66.7 | 14.3 | 200.0 | 200.0 | 14.0 | 17.0 | 19.0 |
| According to Historical Variation | 11.8 | 47.2 | 7.0 | 85.7 | 71.0 | 5.0 | 6.0 | 7.0 |

For example, according to the specification the carbon content (wt % C) could vary approximately 16% of the average value and, as a consequence of this and the variability of the content of other elements, the resulting yield strength can vary 14 to 19 ksi depending on the targeted yield strength of the temperature is not actively controlled to compensate. In examples in which there is a historical knowledge of the real variations of the chemistry, the target temperature could be modified to the most probable average and the potential variation could be reduced to about 5 to 7 ksi.

However, since the actual chemistries could be known (e.g., as provided by a steel supplier), the control system described herein was designed to detect the changes in the weld where the steel chemistry can be different (e.g., different weld material) and can vary the temperature targets along the string accordingly. The use of this control system reduces the yield strength variations due to chemistry and the uncertainty of temperature measurements. The actual target temperature ranges corresponding to the chemistries variations described above are calculated using the system and method of the present invention.

The required change in target temperature is significant enough to fall within the capabilities of process control and hence the changes in chemistry could be compensated if proper control is applied.

Example: Wall Thickness Effects

The variations due to tolerance in wall thickness can be small in comparison to the variations due to taper (e.g., changes in wall thickness introduced on purpose in order to increase axial load capacity). Even in the case of tapers, the effect of power adaptation to the changing wall thickness can be more important than the change in target temperature (as discussed in the example above).

A number of embodiments of the invention have been described. Nevertheless, it will be understood that various modifications may be made without departing from the spirit and scope of the invention. Accordingly, other embodiments are within the scope of the following claims.

What is claimed is:

1. A system comprising:

a feeder configured to feed a continuous length of a tube at a predetermined feed rate, wherein the tube has one or more predetermined geometry values, wherein the one or more predetermined geometry values comprises a wall thickness;

a first treatment station comprising a first entrance, a first exit, and at least a first heat treatment zone therebetween, the first heat treatment zone comprising at least one first zone heating element;

a second treatment station comprising a second entrance, a second exit, and a second heat treatment zone therebetween, the second heat treatment zone comprising a second zone heating element; and a controller configured to (i) power the first zone heating element at an initial heat treatment power level based on the one or more predetermined geometry values of the tube, (ii) adjust power to the first zone heat element based on the wall thickness, and (iii) power the second zone heating element at a second treatment station power level based on the one or more predetermined geometry values of the tube.

2. The system of claim 1, wherein the one or more predetermined geometry values comprises a diameter.

3. The system of claim 1, wherein the one or more predetermined geometry values are provided by a tubing supplier.

4. The system of claim 1, wherein the controller is configured to power the first zone heating element at the initial heat treatment power level based on one or more tube chemistry values.

5. The system of claim 1, further comprising a temperature sensor configured to measure a temperature of the tube at the first exit, wherein the initial heat treatment power level is further based on the temperature.

6. The system of claim 1, further comprising a speed sensor configured to determine an actual feed rate of the continuous length of the tube, wherein a first heat treatment station power level is based on the actual feed rate.

* * * * *